US010352099B2

(12) United States Patent
Spivey et al.

(10) Patent No.: US 10,352,099 B2
(45) Date of Patent: Jul. 16, 2019

(54) METHODS FOR DRILLING A WELLBORE WITHIN A SUBSURFACE REGION AND DRILLING ASSEMBLIES THAT INCLUDE AND/OR UTILIZE THE METHODS

(71) Applicants: Benjamin Spivey, Houston, TX (US); Gregory S. Payette, Spring, TX (US); Darren Pais, Houston, TX (US); Krishnan Kumaran, Raritan, NJ (US); Lei Wang, The Woodlands, TX (US); Jeffrey R. Bailey, Houston, TX (US); Paul E. Pastusek, The Woodlands, TX (US)

(72) Inventors: Benjamin Spivey, Houston, TX (US); Gregory S. Payette, Spring, TX (US); Darren Pais, Houston, TX (US); Krishnan Kumaran, Raritan, NJ (US); Lei Wang, The Woodlands, TX (US); Jeffrey R. Bailey, Houston, TX (US); Paul E. Pastusek, The Woodlands, TX (US)

(73) Assignee: ExxonMobil Upstream Research Company, Spring, TX (US)

( * ) Notice: Subject to any disclaimer, the term of this patent is extended or adjusted under 35 U.S.C. 154(b) by 367 days.

(21) Appl. No.: 15/208,704

(22) Filed: Jul. 13, 2016

(65) Prior Publication Data

US 2017/0058657 A1 Mar. 2, 2017

Related U.S. Application Data

(60) Provisional application No. 62/266,213, filed on Dec. 11, 2015, provisional application No. 62/213,441, filed on Sep. 2, 2015.

(51) Int. Cl.
*E21B 44/02* (2006.01)
*E21B 47/12* (2012.01)
(Continued)

(52) U.S. Cl.
CPC ..... *E21B 7/00* (2013.01)

(58) Field of Classification Search
CPC ..... E21B 7/00
See application file for complete search history.

(56) References Cited

U.S. PATENT DOCUMENTS 5,842,149 A 11/1998 Harrell et al.
6,026,912 A 2/2000 King et al.
(Continued)

FOREIGN PATENT DOCUMENTS

WO WO2008070829 A2 6/2008
WO WO2014078027 A2 5/2014

*Primary Examiner* — Regis J Betsch
*Assistant Examiner* — Jeremy A Delozier
(74) *Attorney, Agent, or Firm* — ExxonMobil Upstream Research Company—Law Department

(57) ABSTRACT

Methods for drilling a wellbore within a subsurface region and drilling assemblies and systems that include and/or utilize the methods are disclosed herein. The methods include receiving a plurality of drilling performance indicator maps, normalizing the plurality of drilling performance indicator maps to generate a plurality of normalized maps, adaptive trending of the plurality of drilling performance indicator maps to generate a plurality of trended maps, summing the plurality of trended maps to generate an objective map, selecting a desired operating regime from the objective map, and adjusting at least one drilling operational parameter of a drilling rig based, at least in part, on the desired operating regime.

31 Claims, 12 Drawing Sheets

(51) Int. Cl.

| | |
|---|---|
| ***E21B 47/06*** | (2012.01) |
| ***E21B 45/00*** | (2006.01) |
| ***E21B 7/00*** | (2006.01) |

(56) References Cited

U.S. PATENT DOCUMENTS

| | | | | |
|---|---|---|---|---|
| 6,293,356 | B1 | 9/2001 | King et al. | |
| 6,382,331 | B1 | 5/2002 | Pinckard | |
| 6,732,052 | B2 | 5/2004 | Macdonald et al. | |
| 7,142,986 | B2 | 11/2006 | Moran | |
| 7,172,037 | B2 | 2/2007 | Dashevskiy et al. | |
| 7,857,047 | B2 | 12/2010 | Remmert et al. | |
| 7,896,105 | B2 | 3/2011 | Dupriest | |
| 8,590,635 | B2 | 11/2013 | Koederitz | |
| 2009/0012711 | A1* | 1/2009 | Harmon | G01V 1/42 702/9 |
| 2011/0185246 | A1 | 7/2011 | Calvo et al. | |
| 2012/0118637 | A1 | 5/2012 | Wang et al. | |
| 2012/0123756 | A1 | 5/2012 | Wang et al. | |
| 2013/0066445 | A1 | 3/2013 | Wang et al. | |
| 2013/0314241 | A1 | 11/2013 | Jamison et al. | |
| 2014/0116776 | A1 | 5/2014 | Marx et al. | |
| 2014/0121972 | A1* | 5/2014 | Wessling | G01V 11/002 702/6 |
| 2014/0277752 | A1* | 9/2014 | Chang | E21B 44/00 700/275 |
| 2014/0343694 | A1 | 11/2014 | Aldred et al. | |
| 2014/0351183 | A1 | 11/2014 | Germain et al. | |
| 2016/0054729 | A1 | 2/2016 | Payette et al. | |

* cited by examiner

METHODS FOR DRILLING A WELLBORE WITHIN A SUBSURFACE REGION AND DRILLING ASSEMBLIES THAT INCLUDE AND/OR UTILIZE THE METHODS

CROSS REFERENCE TO RELATED APPLICATIONS

This application claims the benefit of U.S. Provisional Application No. 62/266,213, filed Dec. 11, 2015, entitled "Methods for Drilling a Wellbore within a Subsurface Region and Drilling Assemblies that Include and/or Utilize the Methods," and U.S. Provisional Application No. 62/213,441, filed Sep. 2, 2015, entitled "Method to Perform Simultaneous Multi-Objective Drilling Function Optimization Given Vibrational Dysfunction Indicators," the disclosure of which is incorporated by reference herein.

FIELD OF THE DISCLOSURE

The present disclosure relates generally to systems and methods for improving wellbore drilling related operations. More particularly, the present disclosure relates to systems and methods that may be implemented in cooperation with hydrocarbon-related drilling operations to improve drilling performance.

BACKGROUND OF THE DISCLOSURE

The oil and gas industry incurs substantial operating costs to drill wells in the exploration and development of hydrocarbon resources. The cost of drilling wells may be considered to be a function of time due to the equipment and manpower expenses based on time. The drilling time can be minimized in at least two ways: 1) maximizing the Rate-of-Penetration (ROP) (i.e., the rate at which a drill bit penetrates the earth); and 2) minimizing the non-drilling rig time (e.g., time spent on tripping equipment to replace or repair equipment, constructing the well during drilling, such as to install casing, and/or performing other treatments on the well). Past efforts have attempted to address each of these approaches. For example, drilling equipment is constantly evolving to improve both the longevity of the equipment and the effectiveness of the equipment at promoting a higher ROP. Moreover, various efforts have been made to model and/or control drilling operations to avoid equipment-damaging and/or ROP-limiting conditions, such as vibrations, bit-balling, etc.

Many attempts to reduce the costs of drilling operations have focused on increasing ROP. For example, U.S. Pat. Nos. 6,026,912; 6,293,356; and 6,382,331 each provide models and equations for use in increasing the ROP. In the methods disclosed in these patents, the operator collects data regarding a drilling operation and identifies a single control variable that can be varied to increase the rate of penetration: In most examples, the control variable is Weight On Bit (WOB); the relationship between WOB and ROP is modeled; and the WOB is varied to increase the ROP. While these methods may result in an increased ROP at a given point in time, this specific parametric change may not be in the best interest of the overall drilling performance in all circumstances. For example, bit failure and/or other mechanical problems may result from the increased WOB and/or ROP. While an increased ROP can drill further and faster during the active drilling, delays introduced by damaged equipment and equipment trips required to replace and/or repair the equipment can lead to a significantly slower overall drilling performance. Furthermore, other parametric changes, such as a change in the rate of rotation of the drill string (RPM), may be more advantageous and lead to better drilling performance than simply optimizing along a single variable.

Because drilling performance is measured by more than just the instantaneous ROP, methods such as those discussed in the above-mentioned patents are inherently limited. Other research has shown that drilling rates can be improved by considering the Mechanical Specific Energy (MSE) of the drilling operation and designing a drilling operation that will minimize MSE. For example, U.S. Pat. Nos. 7,857,047, and 7,896,105, each of which is incorporated herein by reference, discloses methods of calculating and/or monitoring MSE for use in efforts to increase ROP. Specifically, the MSE of the drilling operation over time is used to identify the drilling condition limiting the ROP, which often is referred to as a "founder limiter." Once the founder limiter has been identified, one or more drilling variables can be changed to overcome the founder limiter and increase the ROP. As one example, the MSE pattern may indicate that bit-balling is limiting the ROP. Various measures may then be taken to clear the cuttings from the bit and improve the ROP, either during the ongoing drilling operation or by tripping and changing equipment.

Recently, additional interest has been generated in utilizing artificial neural networks to optimize the drilling operations, for example in U.S. Pat. Nos. 6,732,052, 7,142,986, and 7,172,037. However, the limitations of neural network based approaches constrain their further application. For instance, the result accuracy is sensitive to the quality of the training dataset and network structures. Neural network based optimization is limited to local search and conventionally has difficulty in processing new or highly variable patterns.

In another example, U.S. Pat. No. 5,842,149 disclosed a close-loop drilling system intended to automatically adjust drilling parameters. However, this system requires a lookup table to provide the relations between ROP and drilling parameters. Therefore, the optimization results depend on the effectiveness of this table and the methods used to generate this data. Consequently, the system may lack adaptability to drilling conditions that are not included in the lookup table. Another limitation is that downhole data is required to perform the optimization.

While these past approaches have provided some improvements to drilling operations, further advances and more adaptable approaches are still needed as hydrocarbon resources are pursued in reservoirs that are harder to reach and as drilling costs continue to increase. Further desired improvements may include expanding the optimization efforts from increasing ROP to optimizing the drilling performance measured by a combination of factors, such as ROP, efficiency, downhole dysfunctions, etc. Additional improvements may include expanding the optimization efforts from iterative control of a single control variable to control of multiple control variables. Moreover, improvements may include developing systems and methods capable of recommending operational changes during ongoing drilling operations.

SUMMARY OF THE DISCLOSURE

Methods for drilling a wellbore within a subsurface region and drilling assemblies that include and/or utilize the methods are disclosed herein. The methods may be performed with a drill string of a drilling rig and/or may be performed during a drilling operation of the drilling rig. The methods include receiving a plurality of drilling performance indicator maps. Each of the maps includes information regarding a corresponding mathematically derived drilling performance indicator of the drilling operation and describes the corresponding mathematically derived drilling performance indicator as a function of a plurality of independent drilling operational parameters of the drilling rig.

The methods further include normalizing the plurality of drilling performance indicator maps to generate a plurality of normalized maps. The normalizing includes normalizing each drilling performance indicator map with a corresponding normalizing function. The plurality of normalized maps is defined within a coextensive normalized map range.

The methods also include adaptive trending of the plurality of drilling performance indicator maps to generate a plurality of trended maps. The adaptive trending includes trending each normalized map with a corresponding trending parameter; and the adaptive trending of a given normalized map is based, at least in part, upon at least one statistical parameter that is derived from the corresponding mathematically derived drilling performance indicator.

The methods further include summing, or otherwise combining, the plurality of trended maps to generate an objective map. The objective map describes a correlation between a combination, or sum, of the plurality of trended maps and the plurality of independent drilling operational parameters.

The methods also include selecting a desired operating regime from the objective map and adjusting at least one drilling operational parameter of a drilling rig based, at least in part, on the desired operating regime. The adjusting includes adjusting to generate a plurality of adjusted independent drilling operational parameters.

DETAILED DESCRIPTION AND BEST MODE OF THE DISCLOSURE

Figure 1:
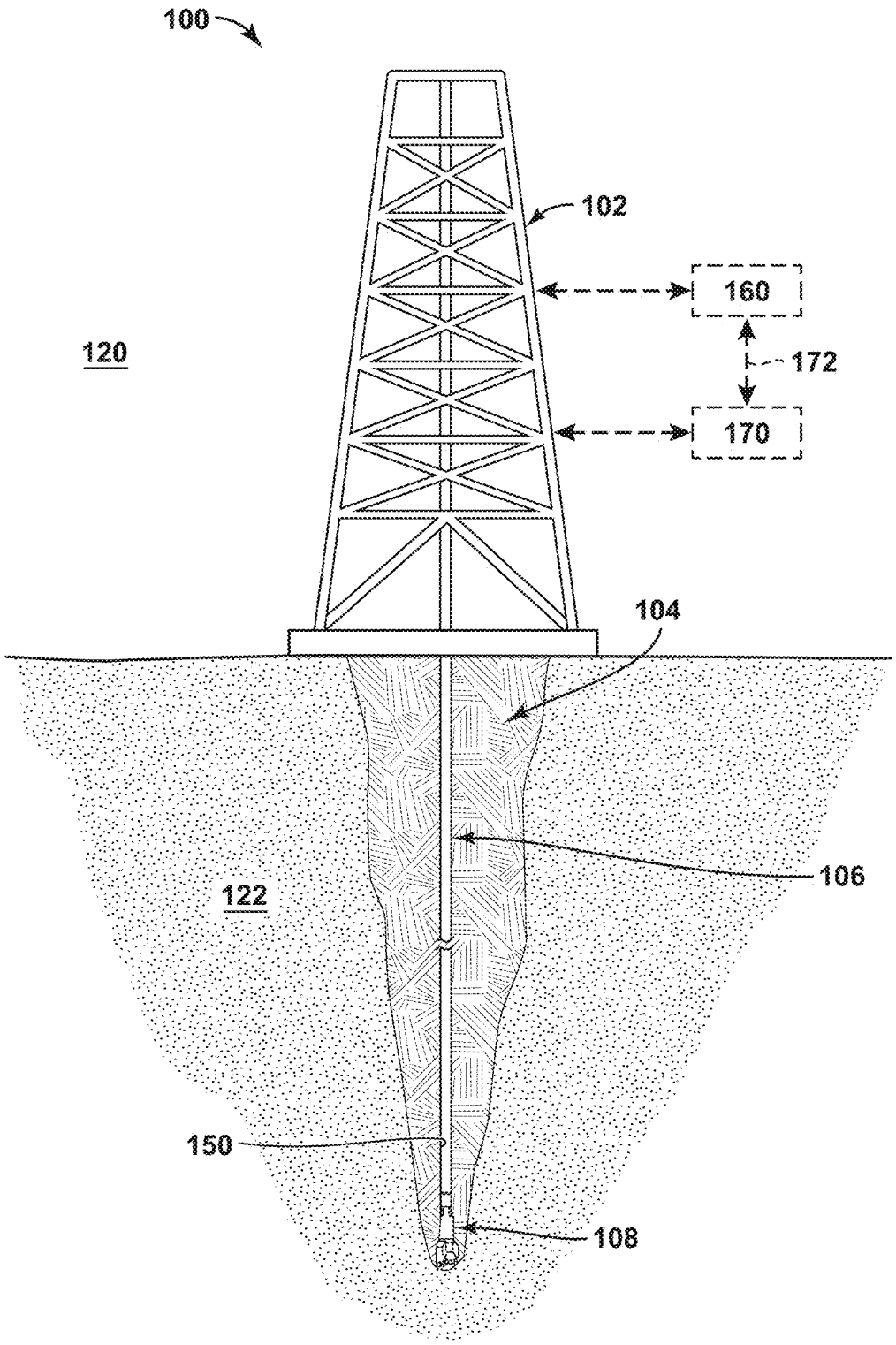
FIG. 1 is a schematic view of a well showing the environment in which the present systems and methods may be implemented.

The following is a listing of terms, phrases, and/or terminology that may be utilized throughout the present disclosure. Also included below are non-limiting definitions that may be utilized to describe and/or define the terms, phrases, and/or terminology used herein.

As used herein, the term "raw drilling data" includes drilling data that may be obtained while drilling a wellbore. Examples of raw drilling data include any and/or all data values that may be recorded, measured, and/or utilized by a drilling rig and/or by one or more sensors of the drilling rig when the drilling rig is performing a drilling operation. Raw drilling data is time-based and/or is represented as a function of time or depth. Raw drilling data may be obtained via instrumentation, sensors, measurements, and/or data signals from the control system on the drilling rig.

Raw drilling data may include "raw drilling operational parameters," such as input parameters, specified variables, operator-selected variables, setpoint variables, independent variables, and/or independent drilling operational parameters. Examples of raw drilling operational parameters include Weight on Bit (WOB), Revolutions per Minute (RPM), a flow rate of drilling mud, and/or a pressure differential of the drilling mud across the drill bit. WOB refers to a weight, or force, that is applied to a drill bit of a drilling rig during drilling a wellbore. WOB may be related to a normal force between the drill bit and the subterranean formation during drilling of the wellbore. RPM refers to a number of revolutions per minute for the drill bit during drilling of the wellbore. The flow rate of drilling mud refers to the flow rate of drilling mud to the wellbore, through a drill string of the drilling rig, and/or into contact with the drill bit. The pressure differential refers to the pressure differential of the drilling mud, across the motor and/or drill bit, when the drilling mud is being supplied into contact with the drill bit via the drill string.

Raw drilling operational parameters may be filtered to generate "filtered drilling operational parameters." Filtered drilling operational parameters include raw drilling operational parameters that have been filtered in any suitable manner. As examples, the raw drilling operational parameters may be filtered as a function of time and/or over any suitable time interval and/or a function of depth and/or over any suitable depth interval. As another example, the raw drilling operational parameters may be filtered over time intervals in which the raw drilling operational parameters are constant, are at least substantially constant, are specified to be constant, and/or are intended to be constant. As yet another example, the filtered drilling operational parameters may include raw drilling operational parameters that have been filtered to remove outliers. This filtering may include applying low-pass filters, high-pass filters, and/or band pass filters, empirical dynamic modeling, p dynamic modeling, state estimation, parameter estimation, moving horizon estimation, and/or Kalman filtering to the raw drilling data and/or excluding regions of the raw drilling data wherein transient behavior is expected and/or observed.

Raw drilling data also may include "raw drilling outputs," such as output parameters, dependent variables, measured variables, and/or determined variables. Examples of raw drilling outputs include a depth of the drill bit within the subterranean formation, block height, differential pressure across the motor and/or bit, and/or hookload. Raw drilling outputs may be filtered to generate "filtered drilling outputs." Filtered drilling outputs include raw drilling outputs that have been filtered in any suitable manner, including those that are discussed herein with reference to raw drilling operational parameters. Each filtered drilling output corresponds to a given set of filtered drilling operational parameters that are based upon raw drilling data collected during the same time interval. This filtering may include applying low-pass filters, high-pass filters, and/or band pass filters, empirical dynamic modeling, physics-based dynamic modeling, state estimation, parameter estimation, moving horizon estimation, and/or Kalman filtering to the raw drilling outputs.

As used herein, the term, "raw mathematically derived drilling performance indicators" may refer to mathematically and/or numerically calculated and/or determined parameters that may be indicative of the performance of the drilling rig operation during drilling of the wellbore and may be represented as a function of time and/or depth. The raw mathematically derived drilling performance indicators may be calculated and/or determined from, or based upon, the raw drilling data, such as from the raw drilling operational parameters and/or from the raw drilling outputs. Additionally or alternatively, the raw mathematically derived drilling performance indicators may be calculated and/or based upon filtered drilling operational parameters and/or filtered drilling outputs and/or raw drilling outputs and/or other mathematically derived drilling performance indicators. Examples of raw mathematically derived drilling performance indicators include a Rate of Penetration (ROP) of the drill string into the subsurface region, a Mechanical Specific Energy (MSE) of the drilling rig operation while drilling the wellbore, a hole cleaning indicator of the wellbore, a vibrational dysfunction of the drilling rig operation, a Torsional Severity Estimate (TSE) of the drilling rig operation which represents a measure of stick-slip motion of a drill string or drill bit of the drilling rig, a drill bit wear parameter, a bottom hole assembly wear parameter, a Depth of Cut (DOC), a ratio of the depth of cut to the weight on bit (i.e., DOC/WOB), a torque on the drill bit during drilling of the wellbore, and/or a vibration of the drill bit during drilling of the wellbore.

It is within the scope of the present disclosure that, depending upon the specific drilling rig that may be utilized to perform a drilling operation, one or more of the above-listed raw mathematically derived drilling performance indicators may be measured, or may be measured directly, during the drilling operation, such as from raw drilling outputs of the drilling operation. As an example, the torque on the drill bit may be measured directly, such as via a torque and/or force transducer of the drilling rig. Under these conditions, the torque on the drill bit is not considered a raw mathematically derived drilling performance indicator and instead is considered a raw drilling output.

As used herein, the term "response point" contains information regarding an "average value" of a given filtered drilling output and/or a given raw drilling output and/or a given mathematically derived performance indicator combined with the "average values" of one or more filtered drilling operational parameters over a finite time or depth interval. The term "average value" with relation to response points herein may refer to any expected value of the output or performance indicator including mean, median, or other statistical estimates of the center of a distribution of the variable as used henceforth. The drilling rig generally will be operated according to a plurality of raw drilling operational parameters (i.e., the raw drilling operational parameters will specify the value of a plurality of controlled variables that may be utilized to regulate operation of the drilling rig). As such, the response point may specify the expected value of the given filtered drilling output and/or raw drilling output and/or of the raw mathematically derived drilling performance indicator along with the expected values of the filtered drilling operational parameters when the drilling rig is operated according to an approximately constant value for the plurality of raw drilling operational parameters or according to approximately constant measured setpoint values for the drilling operational parameters.

Additionally or alternatively, the response points may eliminate the time-variation or depth-variation of the raw drilling data and instead may represent obtained and/or expected average values of the raw drilling outputs and/or of the raw mathematically derived drilling performance indicator when the drilling rig is operated according to specific combinations of average values of the raw drilling operational parameters. As used herein, the phrase "response point dataset" may refer to a database of response points that were collected at different times and/or at different expected values of the filtered drilling operational parameters.

Stated another way, response points provide a one-to-one correspondence between the expected value of the given filtered drilling output and/or of the mathematically derived drilling performance indicator over the given time interval and expected values of the filtered drilling operational parameters over the same time or depth interval. Thus, multiple response points may provide a correlation between the expected values of the filtered drilling operational parameters and the expected values of the given filtered drilling outputs and/or raw drilling outputs and/or of the mathematically derived drilling performance indicators that was produced by the drilling rig when operated at the expected values of the filtered drilling operational parameters.

As used herein, the term "drilling performance indicator map" is a dataset that includes information regarding a "mathematically derived drilling performance indicator" as a function of a plurality of "independent drilling operational parameters". Without loss of generality, a drilling performance indicator map is a dataset which contains a plurality of independent drilling operational parameter data points and a plurality of mathematically derived drilling performance indicators data points. The plurality of independent drilling operational parameter data points are contained on a compact set in $\mathbb{R}^n$ where n is at minimum one and at maximum the number of independent drilling operational parameters. Furthermore, the values of the plurality of mathematically derived drilling performance indicator data points are each determined as a function of the independent drilling operational parameters. The drilling performance indicator map may be based upon and/or determined from the response point dataset. As an example, the plurality of mathematically derived drilling performance indicators may represent the filtered drilling outputs, the raw drilling outputs, or the raw mathematically derived drilling performance indicators. As another example, the plurality of independent drilling operational parameters may represent the raw drilling operational parameters from the response point dataset or the measured setpoint values for the drilling operational parameters. Drilling performance indicator maps also may be referred to herein as "response surfaces" and are not raw drilling data but instead are at least partially derived, calculated, and/or determined from raw drilling data. As an example, each of the plurality of drilling performance indicator data points in the drilling performance indicator map may be calculated using a function that is obtained via a multi-dimensional regression fit, a multi-dimensional least-squares fit, a multi-dimensional extrapolation, and/or multi-dimensional interpolation of the response point dataset. The multi-dimensional regression fit may be further constructed in a manner that unequally weights each response point to give preference to some of the data. For example, the multi-dimensional regression fit may be constructed to give it) preference to a recent response point data or historical response point data which is determined to be consistent with recent response point data. Within the response point dataset, each response point may be weighted to make a contribution to the goodness of fit which may be different than the contribution of another response point within the response point database to the goodness of fit. Under these conditions, the plurality of mathematically derived drilling performance indicators may be the results of this regression fit and the plurality of independent drilling operational parameters may be the expected values of the filtered drilling operational parameters or the measured setpoint values for the drilling operational parameters.

Although not required, each of the plurality of mathematically derived drilling performance indicators in the drilling performance indicator map is defined, or has a corresponding value, at each value of each drilling operational parameter of the plurality of independent drilling operational parameters, where the independent drilling operational parameters are contained on a compact set in $\mathbb{R}^n$ where n is at minimum one and at maximum the number of independent drilling operational parameters. Stated another way, and although not required to all embodiments according to the present disclosure, each of the plurality of mathematically derived drilling performance indicators in the drilling performance indicator map may be defined at the same values of each drilling operational parameter of the plurality of independent drilling operational parameters as every other mathematically derived drilling performance indicator of the plurality of mathematically derived drilling performance indicators. It is within the scope of the present disclosure that drilling performance indicator maps may represent, or may be utilized to represent, the plurality of mathematically derived drilling performance indicators as a plurality of N-dimensional surfaces and/or maps, with N being one greater than a number of the independent drilling operational parameters. The use of response points and response surfaces for use in drilling rig operations is also described in US20130066445 and US20140277752, the complete disclosures of which are hereby incorporated by reference.

As used herein, the term "normalized map" may refer to a drilling performance indicator map that has been normalized by a "normalizing function." The normalizing function may be constant or non-constant with regard to time and/or depth and/or the mathematically derived drilling performance indicator data. The systems and methods disclosed herein may utilize a plurality of drilling performance indicator maps, and these maps may be normalized, by corresponding normalizing functions, such that each of the plurality of drilling performance indicator maps has the same, or at least substantially the same, scale. Such normalization may permit more direct comparison of drilling performance indicator maps that are based upon different drilling outputs that may vary significantly in magnitude. The normalizing function also may non-dimensionalize the corresponding drilling performance indicator map, which also may permit and/or facilitate a more direct comparison among the plurality of drilling performance indicator maps. Such a non-dimensionalized map also may be referred to herein as a "non-dimensional drilling performance indicator map."

As used herein, the term "inverted map" may refer to a normalized map that has been inverted. The inversion also may be referred to herein as flipping the normalized map and selectively may be performed to ensure that relatively more desirable and relatively less desirable regions of the plurality of drilling performance indicator maps are represented in a consistent manner. As an example, the plurality of drilling performance indicator maps may include a rate of cut (ROC) map and a mechanical specific energy map. A higher ROC may be more desirable than a lower ROC. However, a higher mechanical specific energy may be less desirable than a lower mechanical specific energy. Thus, and in order to permit subsequent comparison and/or combination of the ROC map and the friction map, one of the maps may be inverted as discussed herein.

As used herein, the term "trended map" may refer to a normalized map and/or to an inverted map that has had adaptive trending applied (e.g., scaled and/or weighted) by a corresponding "trending parameter." The trending parameter may be a statistical parameter that is derived from the corresponding mathematically derived drilling performance indicator. The adaptive trending may be performed to address and/or quantify differences in an amount in which different mathematically derived drilling performance indicators change for a given change in a given independent drilling operational parameter.

As used herein, the term "objective map" may refer to a combination, or sum, of the plurality of trended maps. The objective map may be utilized to collectively represent all of the mathematically derived drilling performance indicators in a single N-space map, or surface, where N is one greater than the number of independent drilling operational parameters. The objective map also may be referred to herein as, may be utilized to specify, and/or may be utilized to define an "objective surface."

As used herein, the term "objective function" may refer to a single, mathematically derived drilling performance indicator or a mathematical combination of a plurality of mathematically derived drilling performance indicators. The objective function may be utilized to represent the performance of the drilling rig operation.

As used herein, the term "desired operating regime" may refer to an operating regime that may be selected and/or determined based upon the objective map. The desired operating regime may be proximal to a local and/or global extremum of the objective map and may represent an optimized, or quasi-optimized, operating regime for the drilling rig based upon the observed and/or measured interrelation among the filtered drilling operational parameters and the filtered drilling outputs and/or the mathematically derived drilling performance indicators. The objective surface may be utilized to determine values of the plurality of independent drilling operational parameters that are expected to cause the drilling rig to operate within the desired operating regime.

FIGS. 1-21 provide examples of drilling rigs 102, of computer-based systems 300, of methods 200/400, and/or of process flows 500 according to the present disclosure. Elements that serve a similar, or at least substantially similar, purpose are labeled with like numbers in each of FIGS. 1-21, and these elements may not be discussed in detail herein with reference to each of FIGS. 1-21. Similarly, all elements may not be labeled in each of FIGS. 1-21, but reference numerals associated therewith may be utilized herein for consistency. Elements, components, and/or features that are discussed herein with reference to one or more of FIGS. 1-21 may be included in and/or utilized with any of FIGS. 1-21 without departing from the scope of the present disclosure.

In general, elements that are likely to be included are illustrated in solid lines, while elements that are optional are illustrated in dashed lines. However, elements that are shown in solid lines may not be essential to all embodiments.

The methods and systems disclosed herein may receive and/or utilize a plurality of drilling performance indicator maps as an input and may produce and/or generate an objective map as an output. As discussed, the objective map may be a mathematical combination of the plurality of drilling performance indicator maps and may describe the mathematical combination of the plurality of drilling performance indicator maps as a function of a plurality of independent drilling operational parameters. The plurality of drilling performance indicator maps also may be referred to herein as, or may specify, a plurality of corresponding response surfaces for operation of a drilling rig. The plurality of drilling performance indicator maps, or response surfaces, may be determined, calculated, and/or received in any suitable manner.

FIG. 1 illustrates a side view of a relatively generic drilling operation at a drill site 100. FIG. 1 is provided primarily to illustrate an example of a context in which the present systems and methods may be used. As illustrated, the drill site 100 is a land-based drill site having a drilling rig 102 disposed above a well 104. The drilling rig 102 includes a drill string 106 that includes a drill bit 108 disposed at the end thereof. Drill string 106 may extend within a wellbore 150. Wellbore 150 may extend from a surface region 120 and/or may extend within a subsurface region 122. FIG. 1 illustrates wellbore 150 as being vertical, or at least substantially vertical; however, it is within the scope of the present disclosure that the systems and methods described herein also may be utilized in deviated and/or horizontal wellbores.

The subject matter illustrated in FIG. 1 is shown in almost schematic form to show the representative nature thereof. The present systems and methods may be used in connection with any currently available drilling equipment and are expected to be usable with any future developed drilling equipment. Similarly, the present systems and methods are not limited to land-based drilling sites but may be used in connection with offshore, deepwater, arctic, and the other various environments in which drilling operations are conducted.

While the present systems and methods may be used in connection with any drilling operation, they are expected to be used primarily in drilling operations related to the recovery of hydrocarbons, such as oil and gas. Additionally, it is noted here that references to drilling operations are intended to be understood expansively. Operators are able to remove rock from a formation using a variety of apparatus and methods, some of which are different from conventional forward drilling into virgin formation. For example, reaming operations, in a variety of implementations, also remove rock from the formation. Accordingly, the discussion herein referring to drilling parameters, drilling performance measurements, etc., refers to parameters, measurements, and performance during any of the variety of operations that cut rock away from the formation. As is well known in the drilling industry, a number of factors affect the efficiency of drilling operations, including factors within the operators' control and factors that are beyond the operators' control. For the purposes of this application, the term "drilling conditions" will be used to refer generally to the conditions in the wellbore during the drilling operation. The drilling conditions are comprised of a variety of drilling parameters, some of which relate to the environment of the wellbore and/or formation and others that relate to the drilling activity itself. For example, drilling parameters may include rotary speed (RPM), WOB, characteristics of the drill bit and drill string, mud weight, mud flow rate, lithology of the formation, pore pressure of the formation, torque, pressure, temperature, ROP, MSE, vibration measurements, etc. As can be understood from the list above, some of the drilling parameters are controllable and others are not. Similarly, some may be directly measured and others must be calculated based on one or more other measured parameters.

As illustrated in dashed lines in FIG. 1, drilling rig 102, which also may be referred to herein as a drilling assembly 102, may include a controller 160 and/or a monitoring assembly 170. Controller 160 may be programmed to control the operation of drilling rig 102, such as via performing any of the methods disclosed herein. Monitoring assembly 170 may be configured to monitor a plurality of performance indicators of a drilling operation of the drilling rig. Additionally or alternatively, monitoring assembly 170 also may be configured to provide a plurality of monitoring signals 172 to controller 160. Monitoring signals 172 may be indicative of the plurality of performance indicators, which may form at least a portion of a plurality of drilling performance indicator maps, as discussed in more detail herein.

Figure 2:
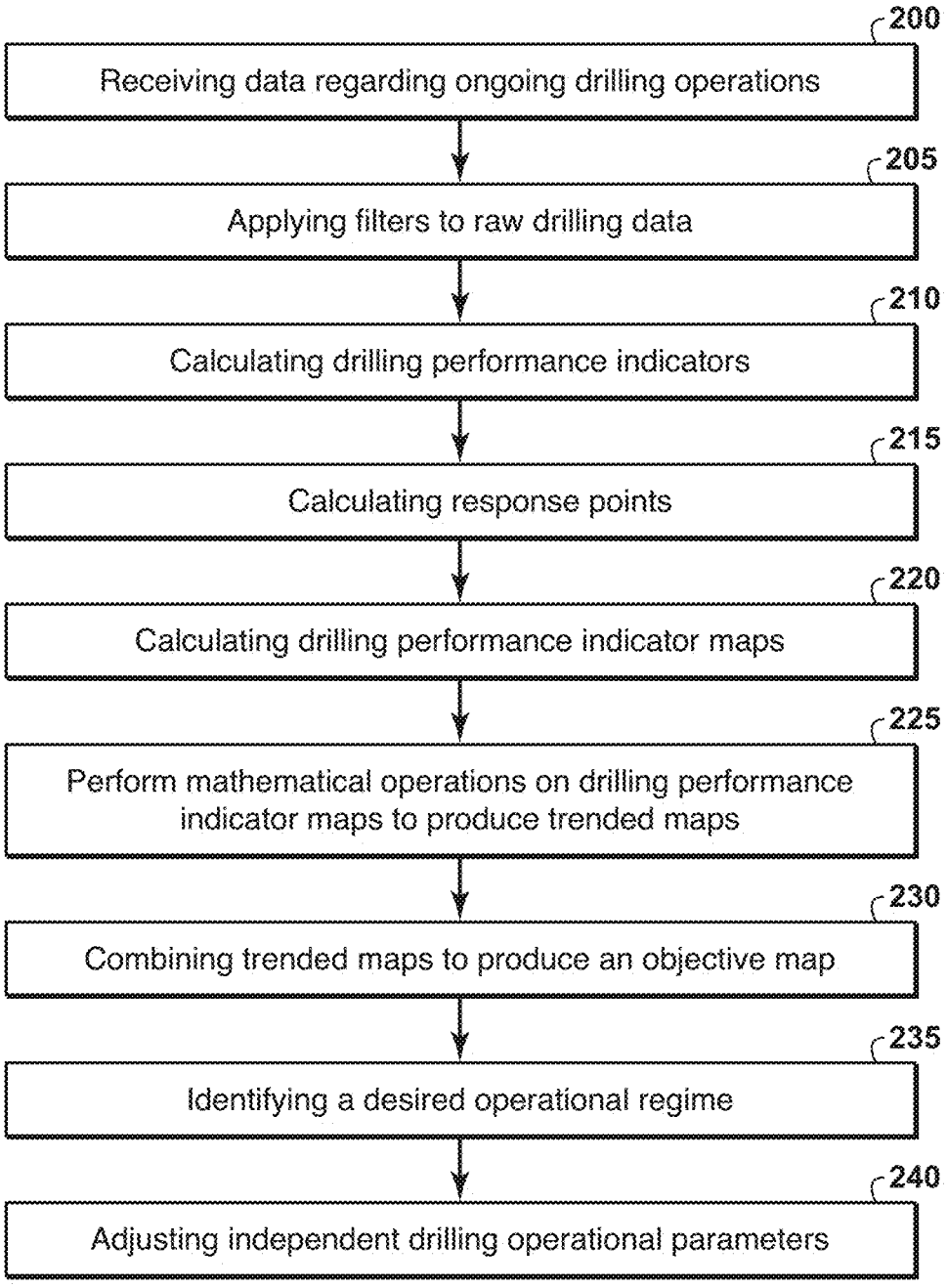
FIG. 2 is a flow chart of methods for updating operational parameters to optimize drilling operations.

FIG. 2 provides an overview of methods disclosed herein for drilling a wellbore. The methods will be expanded upon below. The methods of drilling may include: 1) receiving data regarding ongoing drilling operations 200, specifically, data regarding raw drilling data containing drilling operational parameters and drilling outputs; 2) applying filters to raw drilling data 205 to produce filtered drilling operational parameters and filtered drilling outputs which are continuous in time and/or depth; 3) performing mathematical calculations on data from steps 1 and 2 to produce mathematically derived drilling performance indicators 210 that may be indicative of the performance of the drilling process; 4) mathematically calculating response points 215 to represent the expected values of the filtered drilling outputs and/or the mathematically derived drilling performance indicator over a finite time period or depth period; 5) mathematically calculating drilling performance indicator maps 220 to create a functional relationship between the mathematically derived drilling performance indicators and the independent drilling operational parameters; 6) performing mathematical operations on the "drilling performance indicator" maps to produce trended maps 225; 7) combining, or summing, the trended maps to produce an objective map 230; 8) identifying a desired operational regime 235 from the objective map and independent drilling operational parameters that are expected to cause the drilling rig to operate within the desired operating regime; and/or 9) adjusting independent drilling operational parameters 240 to match the parameters identified in step 7. The applying filters of step 2 may or may not occur concurrently with the receiving data from step 1.

Figure 3:
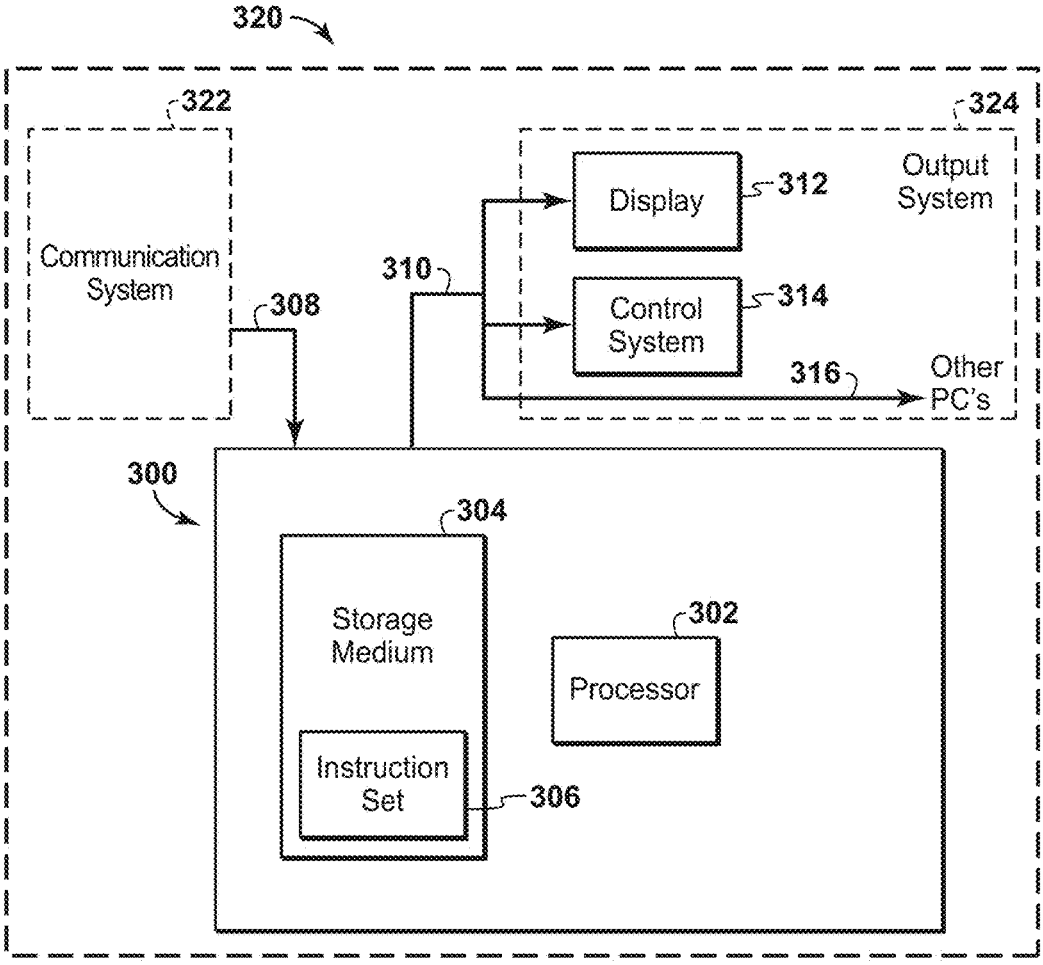
FIG. 3 is a schematic view of systems within the scope of the present disclosure.

FIG. 3 schematically illustrates systems within the scope of the present disclosure. In some implementations, the systems comprise a computer-based system 300 for use in association with drilling operations. The computer-based system may be a computer system, may be a network-based computing system, and/or may be a computer integrated into equipment at the drilling site. The computer-based system 300 comprises a processor 302, a storage medium 304, and at least one instruction set 306. The processor 302 is adapted to execute instructions and may include one or more processors now known or future developed that is commonly used in computing systems. The storage medium 304 also may be referred to herein as computer readable storage media 304 and/or as non-transient computer readable storage media 304. Storage medium 304 is adapted to communicate with the processor 302 and to store data and other information, including the at least one instruction set 306, which also may be referred to herein as a computer-executable instructions 306. When executed, the computer-readable instructions may direct a drilling rig, such as drilling rig 102 of FIG. 1, to perform any suitable portion of any of the methods that are disclosed herein.

The storage medium 304 may include various forms of electronic storage mediums, including one or more storage mediums in communication in any suitable manner. The selection of appropriate processor(s) and storage medium(s) and their relationship to each other may be dependent on the particular implementation. For example, some implementations may utilize multiple processors and an instruction set adapted to utilize the multiple processors so as to increase the speed of the computing steps. Additionally or alternatively, some implementations may be based on a sufficient quantity or diversity of data that multiple storage mediums are desired or storage mediums of particular configurations are desired. Still additionally or alternatively, one or more of the components of the computer-based system may be located remotely from the other components and be connected via any suitable electronic communications system. For example, some implementations of the present systems and methods may refer to historical data from other wells, which may be obtained in some implementations from a centralized server connected via networking technology. One of ordinary skill in the art will be able to select and configure the basic computing components to form the computer-based system.

Importantly, the computer-based system 300 of FIG. 3 is more than a processor 302 and a storage medium 304. The computer-based system 300 of the present disclosure further includes at least one instruction set 306 accessible by the processor and saved in the storage medium. The at least one instruction set 306 is adapted to perform the methods of FIGS. 2 and 4 as described above and/or as described below. As illustrated, the computer-based system 300 receives data at data input 308 and exports data at data export 310. The data input and output ports can be serial port (DB-9 RS232), LAN or wireless network, etc. The at least one instruction set 306 is adapted to export the generated operational recommendations for consideration in controlling drilling operations. In some implementations, the generated operational recommendations may be exported to a display 312 for consideration by a user, such as a driller. In other implementations, the generated operational recommendations may be provided as an audible signal, such as up or down chimes of different characteristics to signal a recommended increase or decrease of WOB, RPM, or some other drilling parameter. In a modern drilling system, the driller is tasked with monitoring of onscreen indicators, and audible indicators, alone or in conjunction with visual representations, may be an effective method to convey the generated recommendations. The audible indicators may be provided in any suitable format, including chimes, bells, tones, verbalized commands, etc. Verbal commands, such as by computer-generated voices, are readily implemented using modern technologies and may be an effective way of ensuring that the right message is heard by the driller. Additionally or alternatively, the generated operational recommendations may be exported to a control system 314 adapted to determine at least one operational update. The control system 314 may be integrated into the computer-based system or may be a separate component. Additionally or alternatively, the control system 314 may be adapted to implement at least one of the determined updates during the drilling operation, automatically, substantially automatically, or upon user activation.

Continuing with the discussion of FIG. 3, some implementations of the present technologies may include drilling rig systems or components of the drilling rig system. For example, the present systems may include a drilling rig system 320 that includes the computer-based system 300 described herein. The drilling rig system 320 of the present disclosure may include a communication system 322 and an output system 324. The communication system 322 may be adapted to receive data regarding at least two drilling parameters relevant to ongoing drilling operations. The output system 324 may be adapted to communicate the generated operational recommendations and/or the determined operational updates for consideration in controlling drilling operations. The communication system 322 may receive data from other parts of an oil field, from the rig and/or wellbore, and/or from another networked data source, such as the Internet. The output system 324 may be adapted to include displays 312, printers, control systems 314, other computers 316, a network at the rig site, or other means of exporting the generated operational recommendations and/or the determined operational updates. The other computers 316 may be located at the rig or in remote offices. In some implementations, the control system 314 may be adapted to implement at least one of the determined operational updates at least substantially automatically. As described above, the present methods and systems may be implemented in any variety of drilling operations. Accordingly, drilling rig systems adapted to implement the methods described herein to optimize drilling performance are within the scope of the present disclosure. For example, various steps of the presently disclosed methods may be done utilizing computer-based systems and algorithms and the results of the presently disclosed methods may be presented to a user for consideration via one or more visual displays, such as monitors, printers, etc., or via audible prompts, as described herein. Accordingly, drilling equipment including or communicating with computer-based systems adapted to perform the presently described methods are within the scope of the present disclosure.

Figure 4:
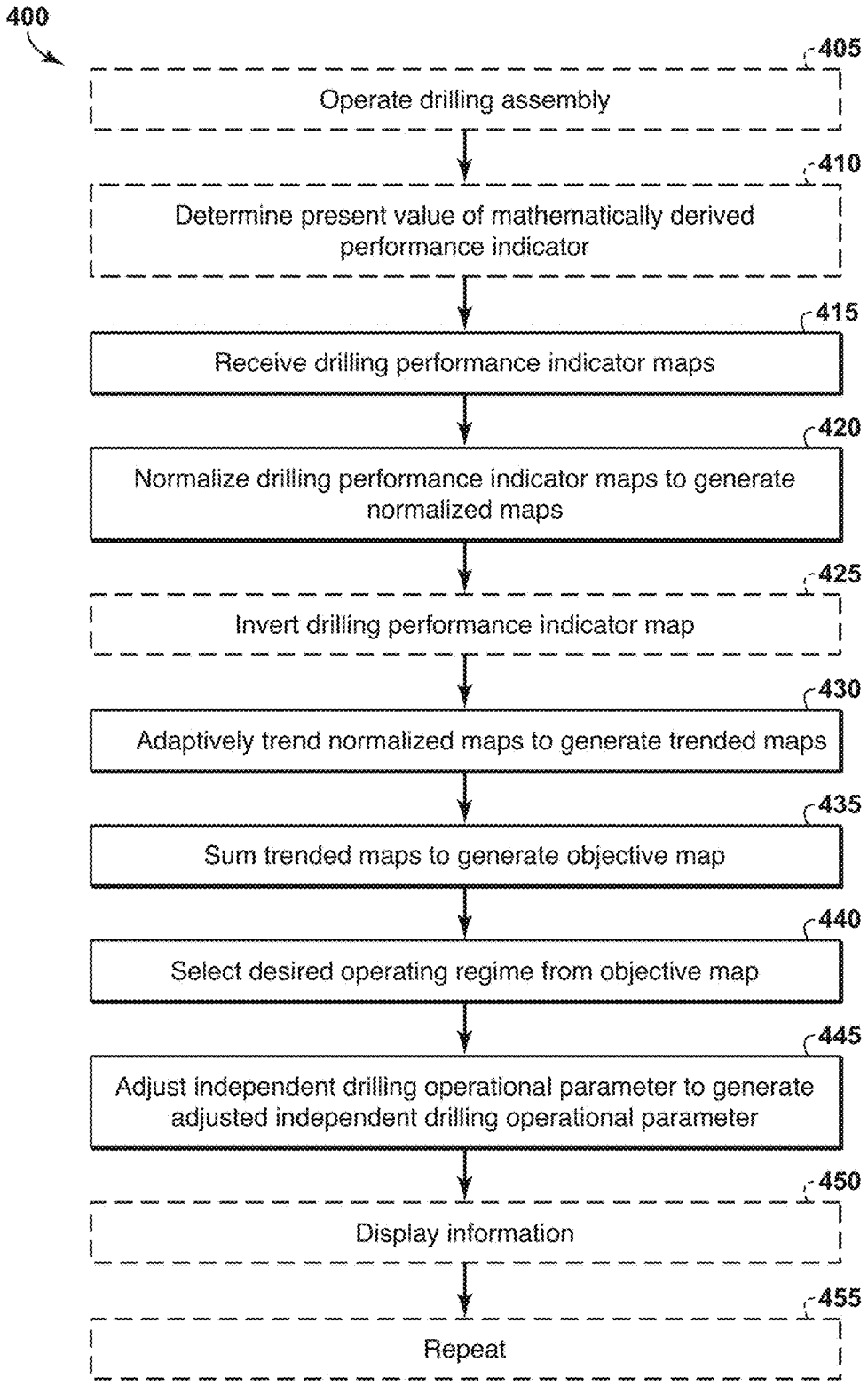
FIG. 4 is a flowchart depicting methods, according to the present disclosure, of drilling a wellbore.
Figure 5:
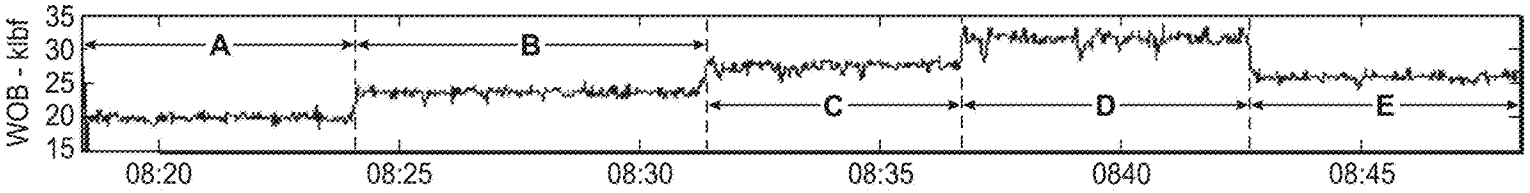
FIG. 5 is a plot of weight on bit as a function of time during drilling of a wellbore with a drilling rig.
Figure 6:
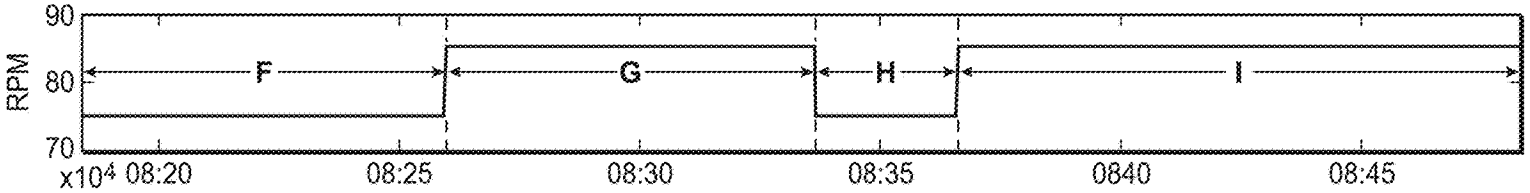
FIG. 6 is a plot of rotations per minute as a function of time during drilling of a wellbore with a drilling rig.
Figure 7:
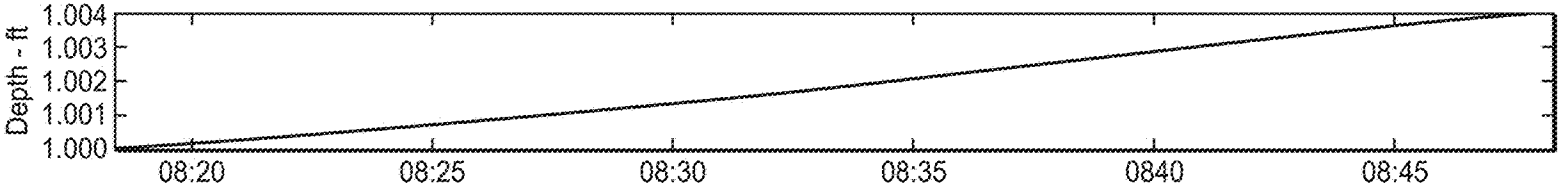
FIG. 7 is a plot of wellbore depth as a function of time during drilling of a wellbore with a drilling rig.
Figure 8:
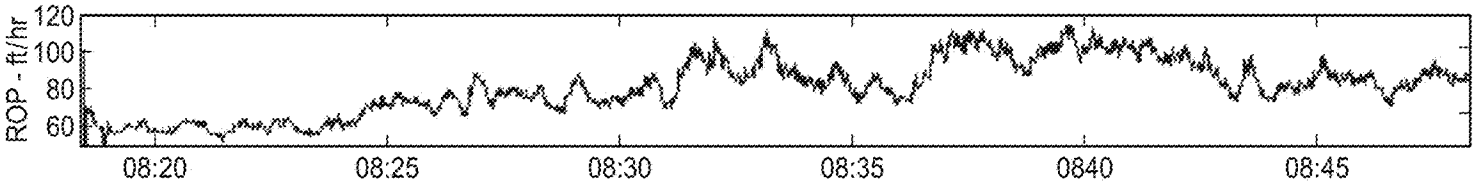
FIG. 8 is a plot of rate of penetration as a function of time during drilling of a wellbore with a drilling rig.
Figure 9:
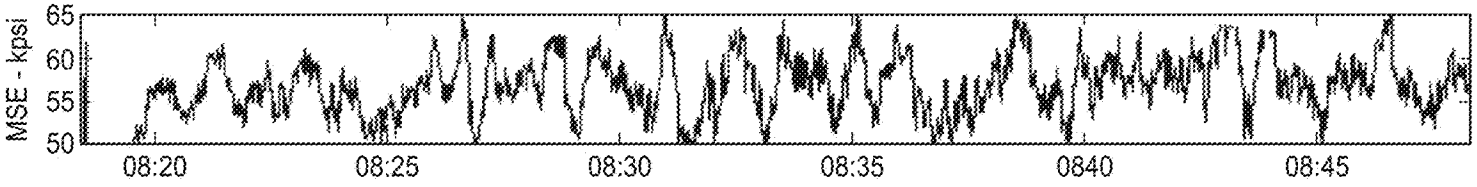
FIG. 9 is a plot of mechanical specific energy as a function of time during drilling of a wellbore with a drilling rig.
Figure 10:
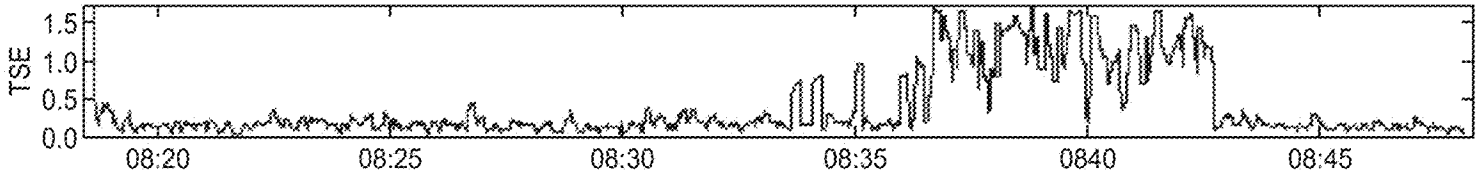
FIG. 10 is a plot of a torsional severity estimate as a function of time during drilling of a wellbore with a drilling rig.
Figure 11:
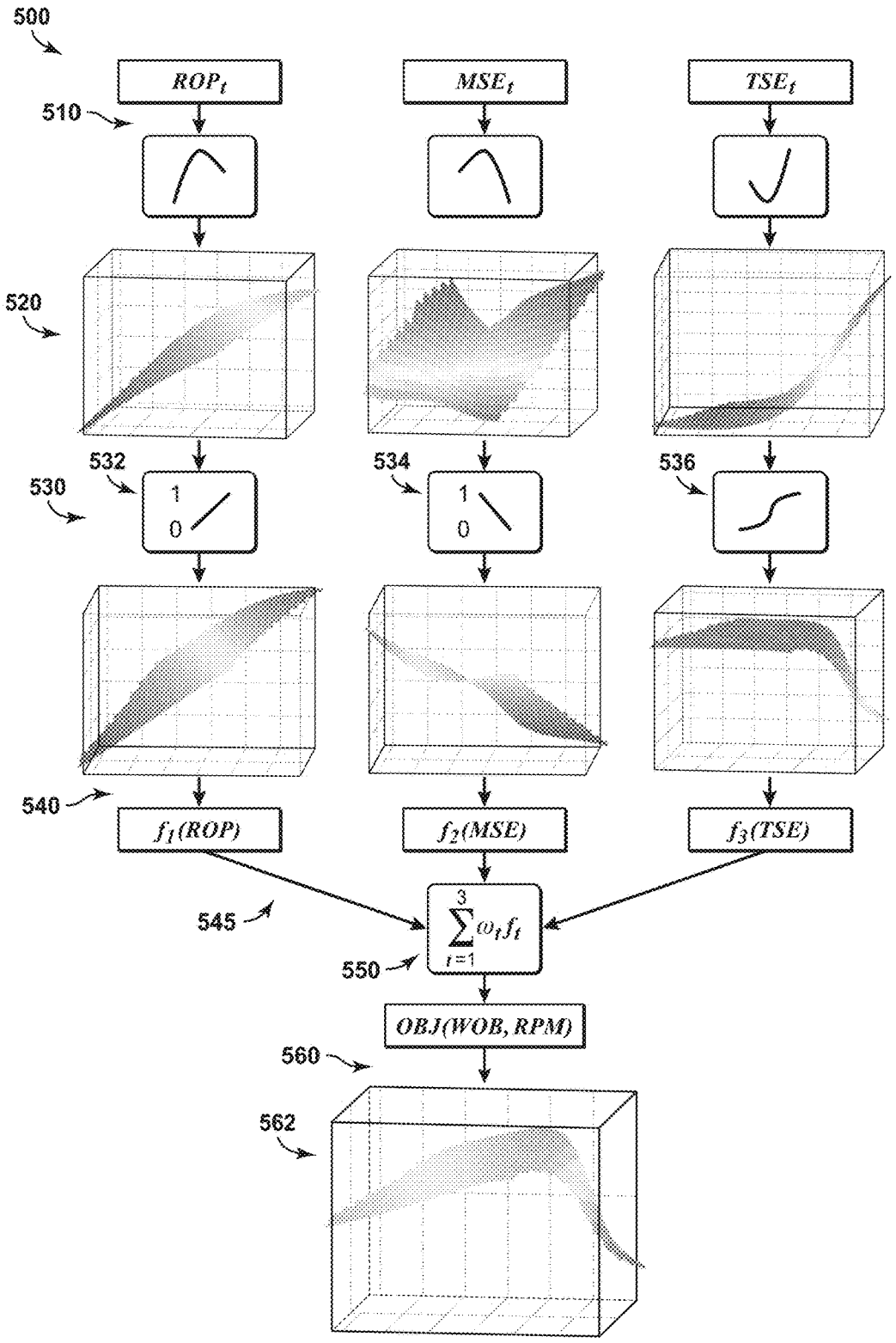
FIG. 11 is a process flow illustrating portions of the method of FIG. 10.
Figure 12:
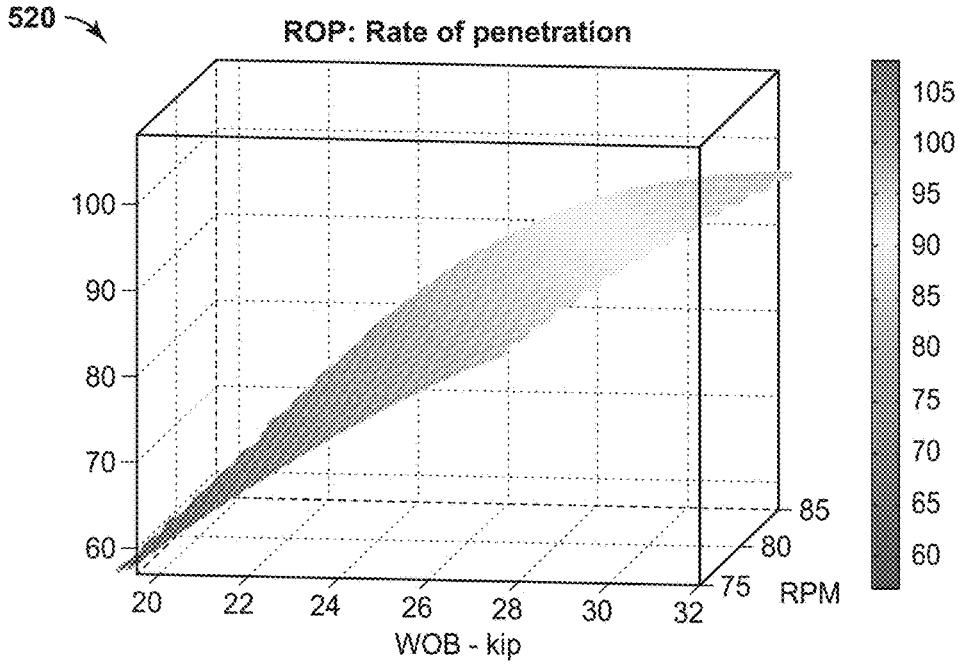
FIG. 12 is a more detailed view of rate of penetration vs. weight on bit and revolutions per minute from the process flow of FIG. 11.
Figure 13:
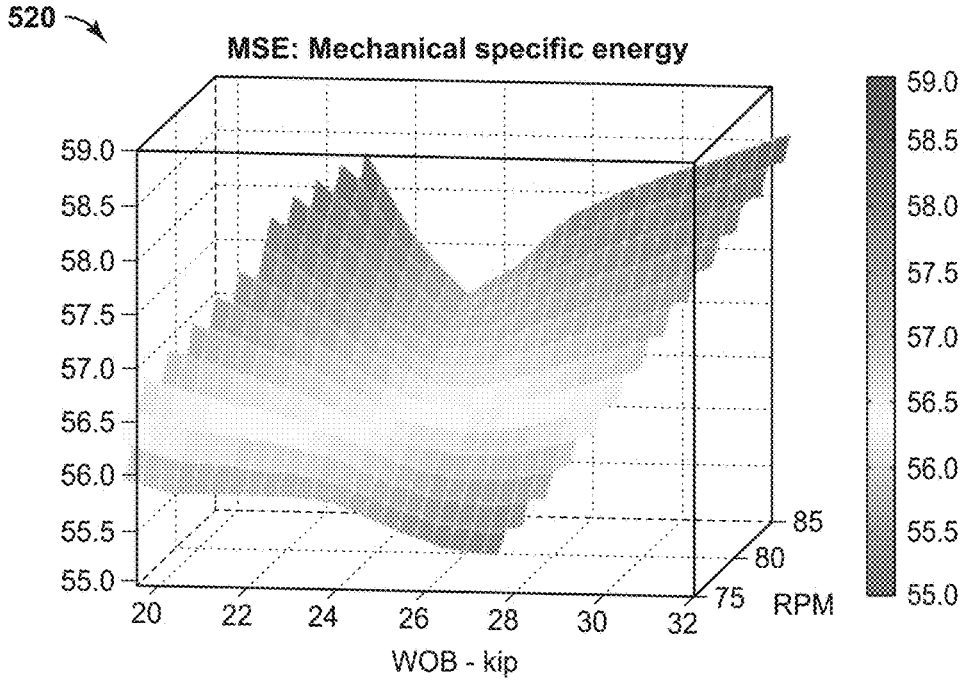
FIG. 13 is a more detailed view of mechanical specific energy vs. weight on bit and revolutions per minute from the process flow of FIG. 11.
Figure 14:
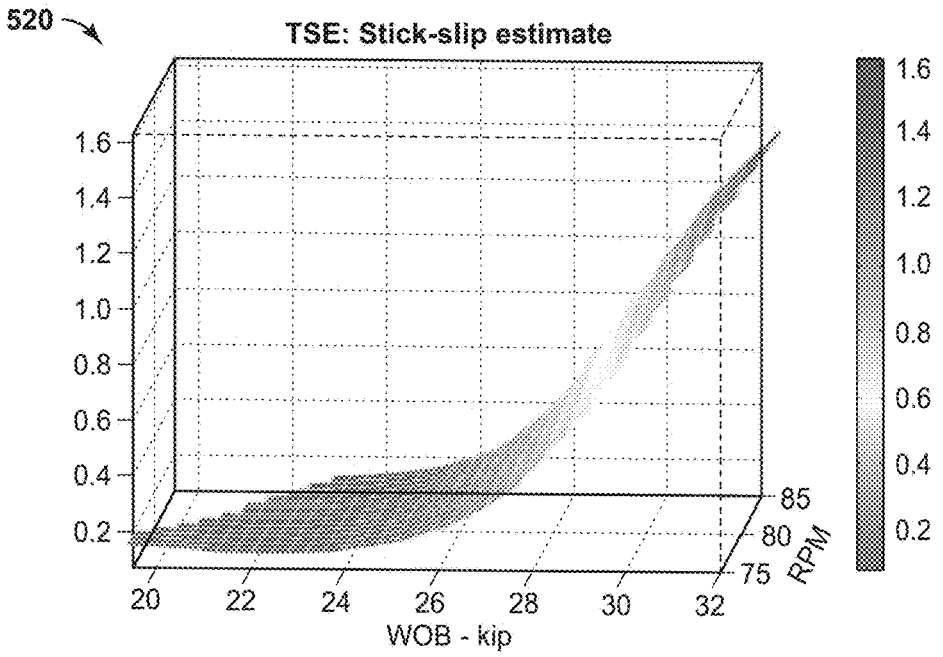
FIG. 14 is a more detailed view of torsional severity estimate vs. weight on bit and revolutions per minute from the process flow of FIG. 11.

FIG. 4 is a flowchart depicting methods 400, according to the present disclosure, of drilling a wellbore. FIGS. 5-7 illustrate raw drilling data that may be generated while performing methods 400, while FIGS. 8-10 illustrate raw mathematically derived drilling performance indicators that may be determined and/or calculated from the raw drilling data. FIG. 11 illustrates a process flow 500 illustrating a portion of methods 400, and FIGS. 12-21 provide more detailed representations of portions of the process flow of FIG. 11.

Methods 400 may be utilized to drill the wellbore with a drilling string of a drilling rig, such as the drilling rig of FIG. 1, and/or within a subsurface region. Methods 400 may include operating the drilling rig at 405 and/or determining a present value of a mathematically derived drilling performance indicator at 410 and include receiving a plurality of drilling performance indicator maps at 415. Methods 400 further include normalizing the plurality of drilling performance indicator maps to generate a plurality of normalized maps at 420 and may include inverting a drilling performance indicator map at 425. Methods 400 also include adaptive trending of the plurality of normalized maps to generate a plurality of trended maps at 430, summing the plurality of trended maps to generate an objective map at 435, selecting a desired operating regime from the objective map at 440, and adjusting an independent drilling operational parameter to generate an adjusted independent drilling operational parameter at 445. Methods 400 further may include displaying information at 450 and/or repeating at least a portion of the methods at 455.

Operating the drilling rig at 405 may include operating the drilling rig according to, or utilizing, a plurality of independent drilling operational parameters. The operating at 405 may be performed prior to the receiving at 415, prior to the adjusting at 445, and/or subsequent to the adjusting at 445. As an example, and prior to the receiving at 415 and/or prior to the adjusting at 445, the operating at 405 initially may include operating the drilling rig according to an initial value of each of the plurality of independent drilling operational parameters. This may include operating to drill at least a portion of a wellbore, and this portion of the wellbore also may be referred to herein as a first, or initial, portion of the wellbore. As another example, and subsequent to the adjusting at 445, the operating at 405 may include operating the drilling rig according to the plurality of adjusted independent drilling operational parameters. This may include operating to drill at least a portion of the wellbore, and this portion of the wellbore also may be referred to herein as a second, or subsequent, portion of the wellbore. Stated another way, the operating at 405 may include increasing a length of the wellbore.

The plurality of independent drilling operational parameters may include any suitable number of parameters. As examples, the plurality of independent drilling operational parameters may include at least 2, at least 3, at least 4, at least 5, at least 6, at least 7, at least 8, or at least 10 independent drilling operational parameters.

The plurality of independent drilling operational parameters may include any suitable independently controlled, or controllable, operational parameter of the drilling rig. Such independently controllable operational parameters may be configured to be selectively and/or independently controlled, varied, specified, and/or selected, such as by an operator of the drilling rig, during drilling of the wellbore with, or via, the drilling rig. Examples of the plurality of independent drilling operational parameters are disclosed herein.

Determining the present value of the mathematically derived drilling performance indicator at 410 may include calculating any suitable mathematically derived drilling performance indicator in any suitable manner. As an example, the determining at 410 may include determining a value of the mathematically derived drilling performance indicator during, or as a result of, the operating at 405. The determining at 410 may be performed during and/or subsequent to the operating at 405.

As discussed in more detail herein, the plurality of drilling performance indicator maps each may be based, at least in part, upon a corresponding mathematically derived drilling performance indictor. The determining at 410 may include determining the present value of the corresponding mathematically derived drilling performance indicator for each of the plurality of drilling performance indicator maps, such as via and/or utilizing the systems and methods of FIGS. 1-3.

The mathematically derived drilling performance indicator may include and/or be any suitable dependent parameter that may result from operation of the drilling rig according to the plurality of independent drilling operational parameters and is mathematically calculated from raw drilling data (i.e., drilling data that is collected and/or measured while drilling) and/or raw drilling outputs and/or filtered drilling operational parameters and/or filtered drilling outputs and/or other mathematically derived drilling performance indicators. Examples of the mathematically derived drilling performance indicators are disclosed herein.

Receiving the plurality of drilling performance indicator maps at 415 may include receiving maps that each includes information regarding a corresponding mathematically it) derived drilling performance indicator of the drilling operation. Additionally or alternatively, each of the plurality of drilling performance indicator maps may describe the corresponding mathematically derived drilling performance indicator as a function of the plurality of independent drilling operational parameters. The plurality of drilling performance indicator maps also may be referred to herein as a plurality of response surfaces and are illustrated at 520 in FIGS. 11-14.

Each drilling performance indicator map may represent, define, and/or specify the corresponding mathematically derived drilling performance indicator or filtered drilling output or raw drilling output in any suitable manner. As examples, one or more of the plurality of drilling performance indicator maps may include, or be, a tabulated relationship between the corresponding mathematically derived drilling performance indicator and the plurality of independent drilling operational parameters, an empirical relationship between the corresponding mathematically derived drilling performance indicator and the plurality of independent drilling operational parameters, and/or a functional relationship between the corresponding mathematically derived drilling performance indicator and the plurality of independent drilling operational parameters.

Regardless of the exact composition of the drilling performance indicator maps, each of the plurality of drilling performance indicator maps may be defined at each value of each drilling operational parameter of the plurality of independent drilling operational parameters where the plurality of independent drilling operational parameters are contained on a compact set in IR where n is at minimum one and at maximum the number of independent drilling operational parameters. Stated another way, each of the plurality of drilling performance indicator maps may be defined at the same values of each drilling operational parameter as every other drilling performance indicator map. Such a composition of the plurality of drilling performance indicator maps may permit and/or facilitate the summing at 435, which is discussed in more detail herein.

The receiving at 415 may include receiving in any suitable manner. As an example, the receiving at 415 may include receiving via and/or utilizing any suitable system or method of any of FIGS. 1-3. This may include receiving a plurality of response surfaces. Under these conditions, the plurality of drilling performance indicator maps may be referred to herein as specifying and/or defining the plurality of response surfaces, and the plurality of response surfaces may specify and/or define operation of the drilling rig according to the plurality of independent drilling operational parameters. As an example, each of the plurality of response surfaces may specify a functional relationship between a corresponding mathematically derived drilling performance indicator and the plurality of independent drilling operational parameters. As another example, each of the plurality of response surfaces may visually, graphically, and/or spatially represent the corresponding mathematically derived drilling performance indicator as a function of the plurality of independent drilling operational parameters, as illustrated at 520 in FIGS. 11-14.

As another example, the receiving at 415 may include mathematically calculating at least a portion of the plurality of drilling performance indicator maps based, at least in part, on the response point dataset. The response points may be mathematically calculated from the expected value of a given filtered drilling output and/or a raw drilling output and/or a given mathematically derived drilling performance indicator. The filtered drilling output may be mathematically calculated by filtering the raw drilling outputs, which is a type of raw drilling data. Under these conditions, methods 400 further may include receiving the raw drilling data. The mathematically calculating may include calculating in any suitable manner. As examples, the mathematically calculating may include filtering the raw drilling data, eliminating one or more outliers from the raw drilling data, interpolation within the raw drilling data, and/or extrapolation of the raw drilling data. As another example, the mathematically calculating may include performing mathematical operations on at least one of raw drilling data and/or raw drilling outputs and/or filtered drilling operational parameters and/or filtered drilling outputs and/or other mathematically derived drilling performance indicators. As yet another example, the mathematically calculating may include determining a functional relationship between at least one raw drilling output of the raw drilling data and the plurality of independent drilling operational parameters. As yet another example, the mathematically calculating may include determining a correlation between at least one raw drilling output of the raw drilling data and the plurality of independent drilling operational parameters. The raw drilling output may include and/or be any suitable dependent, determined, and/or measured output and/or parameter from the drilling operation. It is within the scope of the present disclosure that the plurality of response surfaces and/or the plurality of mathematically derived drilling performance indicators thereof may be specified and/or defined in any suitable number of dimensions. Stated another way, the plurality of response surfaces may be defined and/or specified with respect to any suitable number of independent drilling operational parameters. As an example, each of the plurality of response surfaces may be defined in N-space, where N is one more than the number of independent drilling operational parameters. N may be any suitable positive integer that is greater than 2, such as 3, 4, 5, 6, 7, 8, 9, 10, or more than 10.

It is also within the scope of the present disclosure that the plurality of mathematically derived drilling performance indicators may include any suitable number of mathematically derived drilling performance indicators and/or any suitable number of corresponding drilling performance indicator maps and/or response surfaces. As examples, the plurality of mathematically derived drilling performance indicators may include at least 2, at least 3, at least 4, at least 5, at least 6, at least 8, or at least 10 mathematically derived drilling performance indicators.

The receiving at 415 may include receiving concurrently with the operating at 405, as a result of the operating at 405, concurrently with the repeating at 455, not concurrently with the operating at 405, not concurrently with the repeating at 455, and/or as a result of the repeating at 455. As additional examples, the receiving at 415 may include receiving a plurality of previously generated performance indicator maps, receiving the present value of the corresponding mathematically derived drilling performance indicator, and/or receiving at least substantially concurrently with drilling of the wellbore.

As discussed, each of the plurality of drilling performance indicator maps represents a relationship between the corresponding mathematically derived drilling performance indicator and the plurality of independent drilling operational parameters. As also discussed, the corresponding mathematically derived drilling performance indicator is mathematically calculated from raw data. Thus, the corresponding mathematically derived drilling performance indicator is not raw drilling data and/or is a result of one or more mathematical manipulations of raw drilling data. Similarly, each of the plurality of drilling performance indicator maps is not raw drilling data, is a result of one or more mathematical manipulations of raw drilling data, and/or is calculated from raw drilling data.

As a more specific and/or detailed example, and prior to the receiving at 415, methods 400 may include obtaining raw drilling data from the drilling operation. The raw drilling data may include a plurality of raw drilling operational parameters and a corresponding plurality of raw drilling outputs. The raw drilling data may be represented as a function of time or depth, and an example of such raw drilling data is illustrated in FIGS. 5-7. In FIGS. 5-6, examples of two raw drilling operational parameters are plotted as a function of time. The two raw drilling operational parameters include Weight on Bit (WOB), as illustrated in FIG. 5, and Revolutions Per Minute (RPM), as illustrated in FIG. 6. In FIG. 7, an example of a raw drilling output, depth (DPTH) is plotted as a function of time.

In FIGS. 8-10, examples of three different raw mathematically derived drilling performance indicators are plotted as a function of time. The three different raw mathematically derived drilling performance indicators include Rate of Penetration (ROP), as illustrated in FIG. 8, Mechanical Specific Energy (MSE), as illustrated in FIG. 9, and Torsional Severity Estimate (TSE), as illustrated in FIG. 10. The three different raw mathematically derived drilling performance indicators also are illustrated in FIG. 11 at 510. These raw mathematically derived drilling performance indicators may be represented in raw and/or unfiltered form in FIGS. 8-10 and may be mathematically determined and/or calculated in any suitable manner. As an example, ROP may be determined by dividing a change in block height over a given timeframe by a duration of the given timeframe. As another example, MSE may be calculated from equation (8).

Subsequently, methods 400 may include identifying a time interval over which each of the plurality of raw drilling operational parameters is maintained at a corresponding constant, or at least substantially constant, value. As examples, WOB is maintained at different constant, or at least substantially constant, values during each of time periods A, B, C, D, and E of FIG. 5. Similarly, RPM is maintained at different constant, or at least substantially constant, values during each of time periods F, G, H, and I of FIG. 6.

Methods 400 then may include filtering the raw drilling data, within one or more of the time intervals. In the example of FIGS. 5-10, the filtering may be performed in a plurality of different time intervals. The plurality of different time intervals may include one or more of the overlap between time periods A and F, the overlap between time periods B and F, the overlap between time periods B and G, the overlap between time periods C and G, the overlap between time periods C and H, the overlap between time periods D and I, and/or the overlap between time periods E and I.

The raw drilling data may exhibit time-transient behavior immediately after changing one or more of the raw drilling operational parameters. As such, the filtering may include excluding this time-transient behavior, such as by excluding at least a threshold period of time at the beginning and ending of each time interval.

The filtering additionally or alternatively may include filtering to obtain, or generate, filtered drilling operational parameters (such as filtered WOB and/or filtered RPM). The filtering also may include filtering to obtain, or generate, corresponding filtered drilling outputs (such as filtered DPTH) and/or filtered raw mathematically derived drilling performance indicators (such as filtered ROP, filtered MSE, and/or filtered TSE). The filtering may be accomplished in any suitable manner. As examples, the filtering may include removing outliers and/or applying any suitable low-pass, high-pass, or band-pass filter to the raw drilling data within the one or more time intervals.

Subsequently, methods 400 may include calculating a plurality of mathematically derived drilling performance indicators that may be based, at least in part, on the filtered drilling operational parameters and the corresponding filtered drilling outputs. Examples of the plurality of mathematically derived drilling performance indicators include ROP, MSE, and/or TSE. Additional examples of the plurality of mathematically derived drilling performance indicators are disclosed herein.

Methods 400 then may include calculating one or more statistical values for each filtered drilling operational parameter and each corresponding filtered drilling output or raw mathematically derived drilling performance indicator over each time interval. Methods 400 also may include creating a response point for each corresponding filtered drilling output or raw mathematically derived drilling performance indicator over each time interval. The response point includes an average value of each corresponding filtered drilling output, raw drilling output, and/or a raw mathematically derived performance indicator and an average value of each of the filtered drilling operational parameters during the time interval. Stated another way, the response point specifies a value of each corresponding filtered drilling output, raw drilling output, or raw mathematically derived drilling performance indicator along with a corresponding combination of the filtered drilling operational parameters. Stated yet another way, the response point eliminates the time-based nature of the raw drilling data and instead provides a value of the corresponding filtered drilling output or mathematically derived drilling performance indicator that would be expected to be observed when the drilling rig is operated under the conditions specified by the given combination of the filtered drilling operational parameters.

As discussed, the above-described procedure may be repeated for each time interval that is represented by the raw drilling data. As such, a plurality of response points may be generated and the plurality of response points collectively may be referred to herein as a response point dataset.

The response point dataset then may be utilized to determine and/or calculate a plurality of drilling performance indicator maps, or response surfaces, such as the response surfaces that are discussed herein with reference to FIGS. 1-3. As an example, the plurality of drilling performance indicator maps may be calculated via a multi-dimensional regression fit of the response point dataset. This multi-dimensional regression fit may be performed separately for each subset of the response point dataset that is generated based upon each corresponding filtered drilling output or mathematically derived drilling performance indicator. Such drilling performance indicator maps, or response surfaces, are illustrated graphically in FIGS. 11-14 at 520. Therein, ROP, MSE, and TSE are plotted in separate three-dimensional graphs as a function of WOB and RPM.

Normalizing the plurality of drilling performance indicator maps to generate the plurality of normalized maps at 420 may include normalizing each of the plurality of drilling performance indicator maps with a corresponding normalizing function, such as is illustrated in FIG. 11 at 530. This may include normalizing to generate a plurality of normalized maps, as indicated in FIGS. 11 and 15-17 at 540. Each of the plurality of normalized maps may be defined within a, or the same, coextensive normalized map range.

The normalizing function may include and/or be any suitable linear and/or non-linear normalizing function that may be selected based, at least in part, upon a behavior of a given drilling performance indicator with respect to the plurality of independent drilling operational parameters. As an example, and as indicated in FIG. 11 at 532 and 534, the normalizing at 420 may include linearly normalizing and/or normalizing by inputting the given drilling performance indicator into a linear function, or a linear normalizing function. As another example, and as indicated in FIG. 11 at 536, the normalizing at 420 may include nonlinearly normalizing and/or normalizing by inputting the given drilling performance indicator into a nonlinear function, or a nonlinear normalizing function.

It is within the scope of the present disclosure that the normalizing at 420 may include normalizing a first map of the plurality of drilling performance indicator maps with a first normalizing function. The normalizing at 420 also may include normalizing a second map of the plurality of drilling performance indicator maps with a second normalizing function. The second normalizing function may be different from the first normalizing function.

Figure 15:
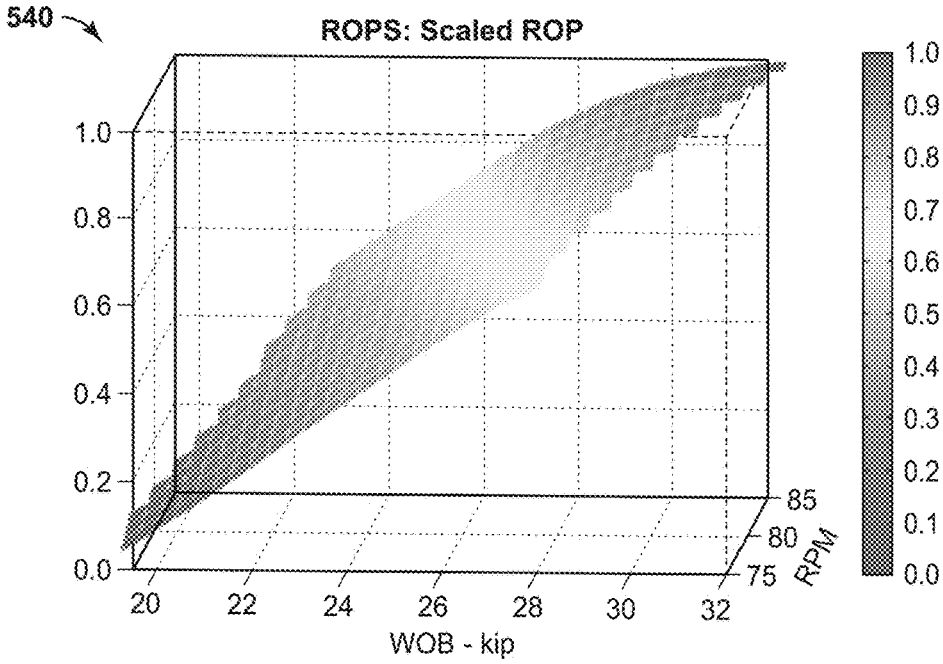
FIG. 15 is a more detailed view of normalized rate of penetration vs. weight on bit and revolutions per minute from the process flow of FIG. 11.
Figure 16:
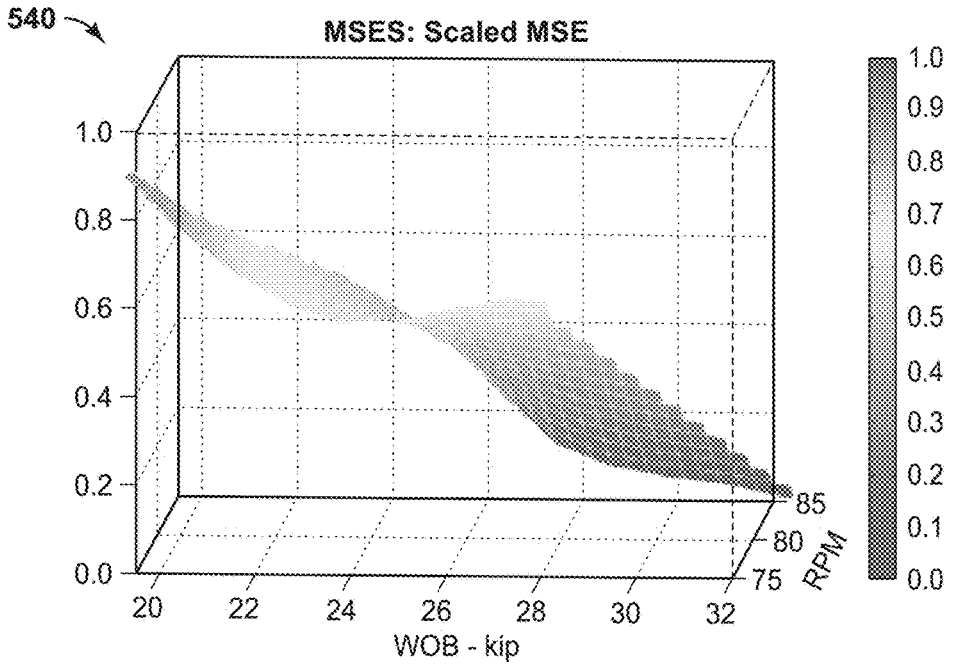
FIG. 16 is a more detailed view of normalized mechanical specific energy vs. weight on bit and revolutions per minute from the process flow of FIG. 11.
Figure 17:
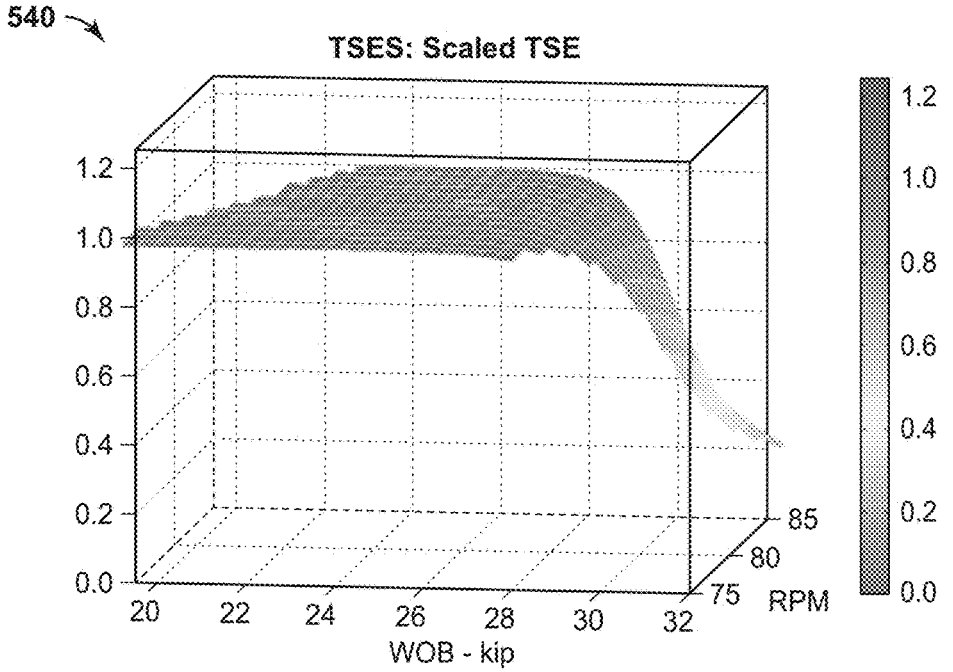
FIG. 17 is a more detailed view of normalized torsional severity estimate vs. weight on bit and revolutions per minute from the process flow of FIG. 11.

The normalizing at 420 may include normalizing such that the coextensive normalized map range is defined between a minimum value and a maximum value, and the minimum and maximum values may be the same, or at least substantially the same, for each of the plurality of drilling performance indicator maps. As an example, and as illustrated in FIGS. 15-17, the minimum value may be 0 and the maximum value may be 1.

The normalizing at 420 may include normalizing any suitable number of the plurality of drilling performance indicator maps. As examples, the normalizing at 420 may include normalizing at least one of the plurality of drilling performance indicator maps. As another example, the normalizing at 420 may include normalizing each of the plurality of drilling performance indicator maps. As yet another example, one or more of the drilling performance indicator maps already may be defined within the coextensive normalized map range. Under these conditions, the normalizing at 420 may include normalizing a remainder of the plurality of drilling performance indicator maps and/or normalizing such that each of the plurality of drilling performance indicator maps is defined within the coextensive normalized map range.

It is within the scope of the present disclosure that the normalizing at 420 may include normalizing to non-dimensionalize each of the plurality of drilling performance indicator maps and/or to ensure that each of the plurality of drilling performance indicator maps is non-dimensionalized, or is a non-dimensional drilling performance indicator map. Additionally or alternatively, it is also within the scope of the present disclosure that the normalizing at 420 may include normalizing to emphasize, or deemphasize, one or more specific ranges, or regions, of one or more of the plurality of drilling performance indicator maps. As an example, the one or more specific ranges may be more important to operation of the drilling rig and/or may have a greater impact on operation of the drilling rig than one or more other ranges, and the normalizing at 420 may be utilized to emphasize the one or more specific ranges.

The normalizing at 420 may include normalizing with any suitable normalizing function. Examples of the normalizing function include a linear function, a nonlinear function, a sigmoid function, and/or a saturation function. The normalizing at 420 also may include normalizing with fuzzy logic.

As a more specific example of the normalizing at 420, the plurality of drilling performance indicator maps may include a Rate of Penetration (ROP) map, and the normalizing at 420 may include normalizing the ROP map between 0 and 1. This may include linearly normalizing the ROP map according to the equation:

$$\overline{ROP} = \frac{ROP - ROP\min}{ROP\max - ROP\min} \tag{1}$$

wherein where $\overline{ROP}$ is a normalized rate of penetration map, ROP is an individual rate of penetration data point from the rate of penetration map, $ROP_{min}$ is a minimum value of the rate of penetration map, and $ROP_{max}$ is a maximum value of the rate of penetration map.

As another more specific example of the normalizing at 420, the plurality of drilling performance indicator maps may include a Depth of Cut (DOC) map, and the normalizing at 420 may include normalizing the DOC map between 0 and 1. This may include linearly normalizing the DOC map according to the equation:

$$\overline{DOC} = \frac{DOC - DOC\min}{DOC\max - DOC\min} \tag{2}$$

where $\overline{DOC}$ is a normalized depth of cut map, DOC is an individual depth of cut data point from the depth of cut map, $DOC_{min}$ is a minimum value of the depth of cut map, and $DOC_{max}$ is a maximum value of the depth of cut map.

As yet another more specific example of the normalizing at 420, the plurality of drilling performance indicator maps may include a ratio of DOC to Weight on Bit (WOB) map (i.e., a DOC/WOB map), and the normalizing at 420 may include normalizing the DOC/WOB map between 0 and 1. This may include linearly normalizing the DOC/WOB map according to the equation:

$$\overline{\left(\frac{DOC}{WOB}\right)} = \frac{\frac{DOC}{WOB} - \frac{DOC}{WOB}\min}{\frac{DOC}{WOB}\max - \frac{DOC}{WOB}\min} \tag{3}$$

where $$\overline{\frac{DOC}{WOB}}$$

is a normalized ratio of depth of cut to weight on bit map, $$\frac{DOC}{WOB}$$

is an individual ratio of depth of cut to weight on bit data point from the ratio of depth of cut to weight on bit map, $$\frac{DOC}{WOB}\min$$

min is a minimum value of the ratio of depth of cut to weight on bit map, and $$\frac{DOC}{WOB}\max$$

max is a maximum value of the ratio of depth of cut to weight on bit map.

As another more specific example of the normalizing at 420, the plurality of drilling performance indicator maps may include a Mechanical Specific Energy (MSE) map, and the normalizing at 420 may include normalizing the MSE map between 0 and 1. This may include linearly normalizing the MSE map according to the equation:

$$\overline{MSE} = \frac{MSE - MSE\min}{MSE\max - MSE\min} \tag{4}$$

where $\overline{MSE}$ is a normalized mechanical specific energy map, MSE is an individual mechanical specific energy data point from the mechanical specific energy map, $MSE_{min}$ is a minimum value of the mechanical specific energy map, and $MSE_{max}$ is a maximum value of the mechanical specific energy map.

As yet another more specific example of the normalizing at 420, the plurality of drilling performance indicator maps may include a Torsional Severity Estimate (TSE) map, and the normalizing at 420 may include normalizing the TSE map between 0 and a positive real number. This may include nonlinearly normalizing the TSE map utilizing at least one sigmoid. An example of nonlinearly normalizing the TSE map using multiple sigmoids is shown in the equations:

$$f_i(TSE) = \beta \cdot \frac{1}{1 + e^{-z_i}} \tag{5}$$

$$z_i(TSE) = w_i \cdot (TSE - 1) \tag{6}$$

$$\overline{TSE} = f_3(TSE) \cdot f_1(TSE) + (1 - f_3(TSE)) \cdot f_2(TSE) \tag{7}$$

where $w_i$ is a coefficient that may be a constant or may be mathematically calculated using constants and the TSE mathematically derived drilling performance indicator map.

Inverting the drilling performance indicator map at 425 may include inverting at least one drilling performance indicator map of the plurality of drilling performance indicator maps or inverting an inverted portion of the plurality of drilling performance indicator maps. This may include inverting to generate at least one inverted map, and the inverted map may form a portion of the plurality of normalized maps. The inverting at 425 may include multiplying the at least one mathematically derived drilling performance indicator map by a negative number, multiplying the at least one mathematically derived drilling performance indicator map by a negative number prior to the normalizing at 420, subtracting the at least one mathematically derived drilling performance indicator map from 1, inputting the at least one mathematically derived drilling performance indicator map into a function that has a negative slope, and/or inputting a corresponding normalized map that is based upon the at least one mathematically derived drilling performance indicator map into the function that has a negative slope. As an example, such a function that has a negative slope is illustrated in FIG. 11 at 534.

The inverting at 425 may include selectively and/or purposefully inverting one or more selected ones of the plurality of performance indicator maps, such as to cause an overall trend of the one or more selected ones of the plurality of performance indicator maps to be complementary to an overall trend of a remainder of the plurality of performance indicator maps. As an example, the inverting at 425 may include inverting such that one of a minimum value of the coextensive normalized map range and a maximum value of the coextensive normalized map range corresponds to a relatively more desirable operating regime for the drilling rig with respect to each corresponding mathematically derived drilling performance indicator. As another example, the inverting at 425 may include inverting such that the other of the minimum value of the coextensive normalized map range and the maximum value of the coextensive normalized map range corresponds to a relatively less desirable operating regime for the drilling rig with respect to each corresponding mathematically derived drilling performance indicator.

As a more specific example of the inverting at 425, the plurality of drilling performance indicator maps may include a Mechanical Specific Energy (MSE) map, and the inverting at 425 may include subtracting the normalized map from one according to the equation:

$$\overline{MSE} = 1 - \frac{MSE - MSE\min}{MSE\max - MSE\min} \tag{8}$$

where $\overline{MSE}$ is an inverted mechanical specific energy map, MSE is an individual mechanical specific energy data point from the mechanical specific energy map, $MSE_{min}$ is a minimum value of the mechanical specific energy map, and $MSE_{max}$ is a maximum value of the mechanical specific energy map.

Adaptive trending of the plurality of normalized maps to generate the plurality of trended maps at 430 may include adaptive trending with corresponding trending parameters. The adaptive trending at 430 may include scaling and/or weighting the plurality of normalized maps, by the corresponding trending parameters, to change a range of at least a portion of the plurality of normalized maps, to emphasize a given trended map when compared to another trended map, and/or de-emphasize a given trended map when compared to another trended map. The emphasis and/or de-emphasis of the given trended map may be based upon a variation in the corresponding mathematically derived drilling performance indicator with changes in one or more of the plurality of independent drilling operational parameters.

The adaptive trending at 430 may be accomplished in any suitable manner. As an example, the adaptive trending at 430 may include multiplying at least one of the plurality of normalized maps by the corresponding trending parameter. As another example, the adaptive trending at 430 may include multiplying each of the plurality of normalized maps by the corresponding trending parameter for that normalized map.

The trending parameters may be established, calculated, and/or determined in any suitable manner. As an example, at least one of the trending parameters may be based, at least in part, upon at least one statistical parameter derived from the corresponding mathematically derived drilling performance indicator. As another example, the trending parameters may be based, at least in part, on a variability of each of the normalized maps. The trending parameters may include a, or one, trending parameter for each normalized map, and the trending parameters may not be the same for each of the normalized maps. Stated another way, at least one normalized map may have a different trending parameter than at least one other normalized map.

As another example, methods 400 may include calculating the corresponding trending parameter based, at least in part, on a statistical analysis of the corresponding drilling performance indicator map. As yet another example, the corresponding trending parameter may include, or be an absolute variance of the corresponding normalized map.

As a more specific example, the corresponding trending parameter may be calculated from the equation:

$$\omega_i = \frac{\sigma_i}{\tilde{x}_i} \tag{9}$$

where $\omega_i$ is the corresponding trending parameter, $\sigma_i$ is the standard deviation of a corresponding drilling performance indicator map of each normalized map, and $\tilde{x}_i$ is an expected value of the corresponding drilling performance indicator map.

As another more specific example, the corresponding trending parameter may be calculated from the equation:

$$\omega_i = \frac{x_{max} - x_{min}}{\tilde{x}_i} \tag{10}$$

where $\omega_i$ is the corresponding trending parameter, $x_{max}$ is a maximum value of a corresponding drilling performance indicator map of each normalized map, $x_{min}$ is a minimum value of a corresponding drilling performance indicator map of each normalized map, and $\tilde{x}_i$ is an expected value of the corresponding drilling performance indicator map.

Figure 18:
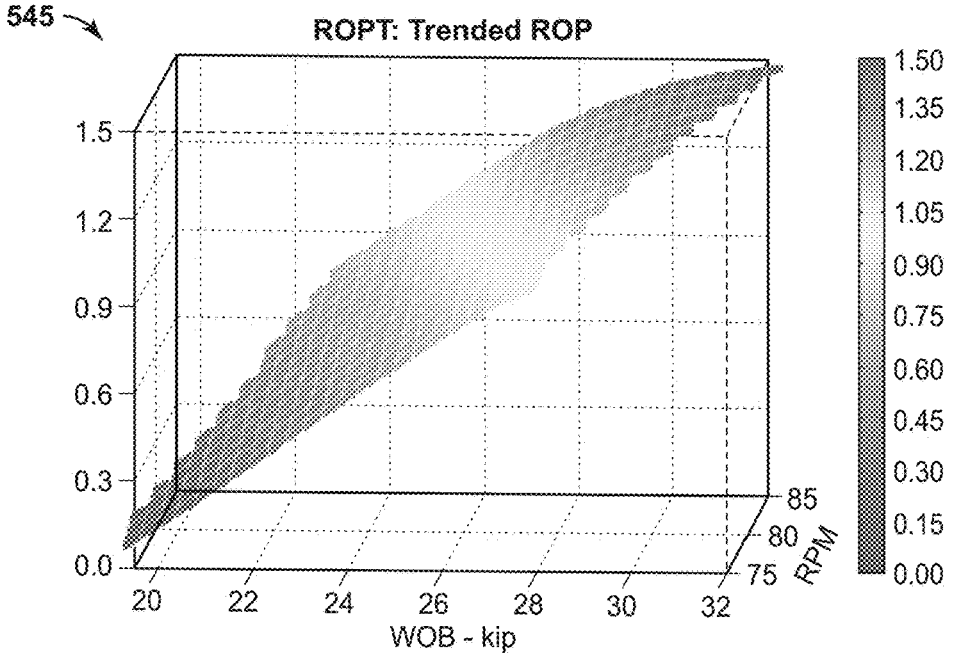
FIG. 18 is a more detailed view of trended rate of penetration vs. weight on bit and revolutions per minute from the process flow of FIG. 11.
Figure 19:
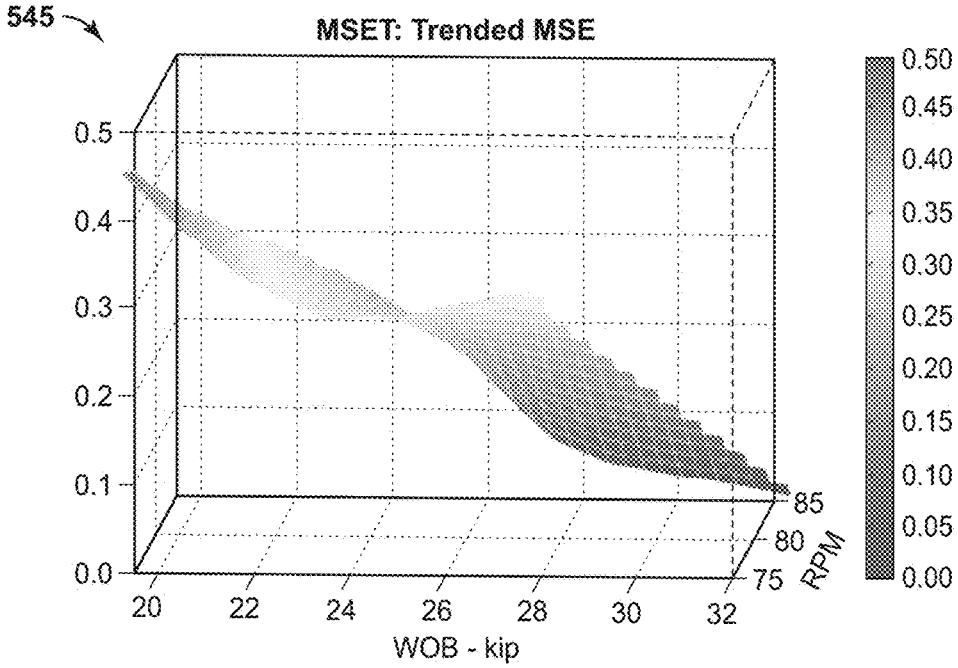
FIG. 19 is a more detailed view of trended mechanical specific energy vs. weight on bit and revolutions per minute from the process flow of FIG. 11.
Figure 20:
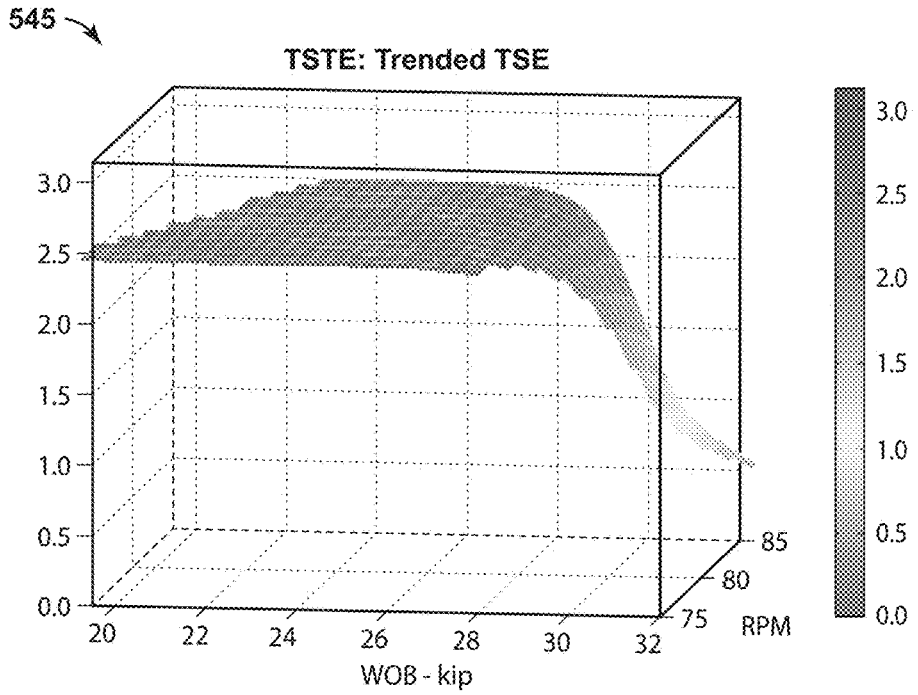
FIG. 20 is a more detailed view of trended torsional severity estimate vs. weight on it) bit and revolutions per minute from the process flow of FIG. 11.

The adaptive trending at 430 is illustrated in FIG. 11 at 545. Therein, each normalized and/or inverted map, $f_i$, is multiplied by a corresponding trending parameter, $\omega_i$. This may include trending to generate a plurality of trended maps, as illustrated in FIGS. 18-20 at 545.

Summing the plurality of trended maps to generate the objective map at 435 is illustrated in FIG. 11 at 550. Therein, the plurality of trended maps (i.e., $f_i\omega_i$) is summed to generate the objective map (OBJ), which is indicated at 560.

The summing at 435 may include summing in any suitable manner. As an example, the summing at 435 may include utilizing superposition. As another example, each of the plurality of trended maps may have a corresponding value at each of a plurality of distinct combinations of the plurality of independent drilling operational parameters, where the independent drilling operational parameters are contained on a compact set in $\mathbb{R}^n$ where n is at minimum one and at maximum the number of independent drilling operational parameters. Under these conditions, the summing at 435 may include summing, or adding, the corresponding value for each of the plurality of trended maps at each of the plurality of distinct combinations of the plurality of independent drilling operational parameters. Thus, the objective map will have a corresponding value at each of the plurality of distinct combinations of the plurality of independent drilling operational parameters, and the corresponding value at a given combination of the plurality of independent drilling operational parameters will be equal to the sum of the value of each of the plurality of trended maps at the given combination of the plurality of independent drilling operational parameters.

The objective map may describe a correlation, relationship, and/or functional behavior between a combination of the plurality of trended maps and the plurality of independent drilling operational parameters. Stated another way, the objective map may include, or be, a single map, dataset, and/or surface that specifies a value of the combination of the plurality of trended maps for various combinations of the plurality of independent drilling operational parameters.

As discussed herein, the objective map also may be referred to herein as, or may describe, an objective surface. Such an objective surface is illustrated in FIG. 11 at 562 and also in FIG. 21.

Thus, the summing at 435 also may be referred to herein as, or may include, specifying the objective surface. The objective map and/or the objective surface may describe operation of the drilling rig according to the plurality of independent drilling operational parameters. The objective surface also may be referred to herein as a composite objective surface that describes the combination of the plurality of trended maps as a function of the plurality of independent drilling operational parameters. Similar to the plurality of response surfaces, the objective surface and/or the objective map may be defined in N-space. As a more specific example of the summing, the ROP map, MSE map, and TSE map may be summed to create the objective function according to the equation:

$$OBJ=\omega_{ROP}\cdot\overline{ROP}+\omega_{MSE}\cdot\overline{MSE}+\omega_{TSE}\cdot\overline{TSE}. \quad (11)$$

The summing at 435 additionally or alternatively may be referred to herein as, or may include, determining a correlation and/or relationship between an objective function and the plurality of independent drilling operational parameters. Additionally or alternatively, the summing at 435 may be referred to herein as, or may include, determining a tabulated relationship and/or an empirical relationship between the objective function and the plurality of independent drilling operational parameters. The objective function may be based, at least in part, on the objective map.

Selecting the desired operating regime from the objective map at 440 may include selecting any suitable desired operating regime, region, and/or area for the drilling operation based upon any suitable criteria. As an example, and as discussed, the normalizing at 420 and/or the inverting at 425 may include normalizing and/or inverting such that each of the plurality of trended maps represents relatively more desirable operating regimes and relatively less desirable operating regimes in a consistent manner. As such, the summing at 435 will generate a cooperative effect in which operating regimes that are relatively more desirable for several of the plurality of drilling performance indicator maps will be emphasized in the objective map (e.g., will have a relatively larger value or a relatively smaller value depending upon the manner in which the normalizing at 420 and/or the inverting at 425 is performed). Conversely, operating regimes that are relatively less desirable for several of the plurality of drilling performance indicator maps will be de-emphasized in the objective map.

Figure 21:
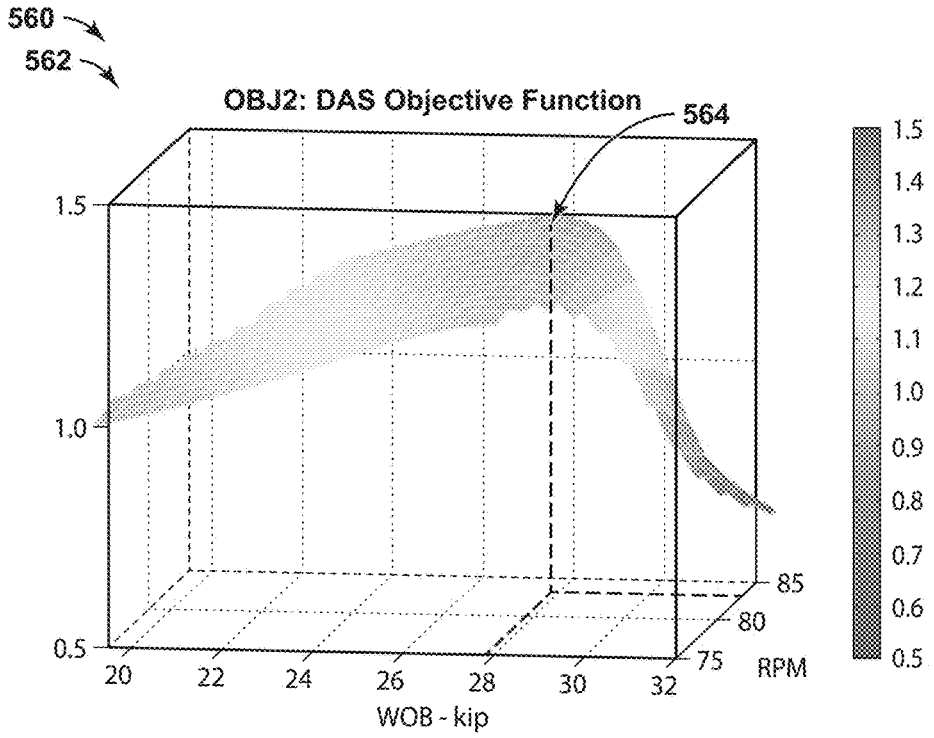
FIG. 21 is a more detailed view of an objective map that may be generated utilizing the method of FIG. 4 and/or the process flow of FIG. 11.

With this in mind, the selecting at 440 may include selecting a local, or global, extremum of the objective map. This may include selecting a local minimum, a global minimum, a local maximum, and/or a global maximum of the objective map. As a more specific example, and as illustrated in FIG. 21, the normalizing at 420 and/or the inverting at 425 may include normalizing and/or inverting such that the relatively more desirable operating regime has a relatively greater value in the objective map and/or in an objective surface 562 that is based thereon. Under these conditions, the selecting at 440 may include selecting a maximum 564 of the objective map, and/or of the objective surface thereof, as a central point for the desired operating regime.

The selecting at 440 further may include determining the plurality of adjusted independent drilling parameters, and the plurality of adjusted independent drilling parameters may be specified and/or defined by the desired operating regime. As an example, and with continued reference to FIG. 21, values of WOB and RPM that are associated with maximum 564 may be utilized to at least partially specify and/or define the desired operating regime.

The selecting at 440 may include selecting in any suitable manner. As an example, the selecting at 440 may include automatically selecting the desired operating regime, such as via and/or utilizing controller 160 of FIG. 1 and/or computer-based system 300 of FIG. 3. As another example, the selecting at 440 may include selecting by an operator of the drilling rig, and it is within the scope of the present disclosure that engineering judgement may be utilized to select a desired operating regime that is based upon the objective map and/or the objective surface but that does not necessarily correspond exactly to maximum 564 (or a minimum, as the case may be).

It is within the scope of the present disclosure that the selecting at 440 may include selecting and/or determining a setpoint, or setpoint value, for at least a portion of the plurality of adjusted independent drilling operational parameters. Additionally or alternatively, the selecting at 440 may include selecting and/or determining a desired operating range for at least a portion of the plurality of adjusted independent drilling operational parameters, and this desired operating range is not required to correspond exactly to a minimum, or maximum, of the objective map.

Adjusting the independent drilling operational parameter to generate the adjusted independent drilling operational parameter at 445 may include adjusting any suitable number of the independent drilling operational parameters in any suitable manner such that the adjusted independent drilling operational parameter includes at least one changed parameter. As examples, the adjusting at 445 may include adjusting at least one of, adjusting a plurality of, and/or adjusting each of the plurality of independent drilling operational parameters. As additional examples, the adjusting at 445 may include changing at least one drilling operational parameter from a previous value to an adjusted value, changing at least two of the drilling operational parameters from a corresponding previous value to a corresponding adjusted value, increasing at least one drilling operational parameter, and/or decreasing at least one drilling operational parameter.

Displaying the information at 450 may include displaying any suitable information that may be received by and/or generated via methods 400. As examples, the displaying at 450 may include displaying one or more of the objective map, the objective surface, at least one drilling performance indicator map, at least one normalized map, at least one trended map, and/or at least one adjusted independent drilling operational parameter. When methods 400 include the displaying at 450, the selecting at 440 may include selecting by the operator of the drilling rig based, at least in part, on the displaying.

Repeating at least the portion of the methods at 455 may include repeating any suitable portion of methods 400 in any suitable manner and/or in any suitable sequence. As an example, the plurality of adjusted independent drilling operational parameters may be a first plurality of adjusted independent drilling operational parameters, and the repeating at 455 may include repeating at least the selecting at 440 and the adjusting at 445 to generate a second plurality of adjusted independent drilling operational parameters that is different from the first plurality of adjusted independent drilling operational parameters.

As another example, the objective map may be a first objective map and the repeating at 455 further may include repeating the adaptive trending at 430 and the summing at 435 to generate a second objective map. The second objective map may be based upon different drilling performance indicator maps than the first objective map. Under these conditions, the repeating at 455 further may include repeating the receiving at 415 and the normalizing at 420. Additionally or alternatively, the second objective map may be based upon the same drilling performance indicator maps as the first objective map. Under these conditions, the repeating the adaptive trending may include repeating with different trending parameters.

The repeating at 455 may be initiated based upon any suitable criteria. As an example, the repeating at 455 may be operator-initiated by an operator of the drilling rig, such as may be based upon engineering judgement. As another example, the repeating at 455 may be automatically initiated. When the repeating at 455 is automatically initiated, the automatic initiation may be based upon one or more of a monitored performance indicator of the drilling operation and/or expiration of at least a threshold operating time. The repeating at 455 further may include classifying at least one drilling characteristic of the subsurface region.

In the present disclosure, several of the illustrative, non-exclusive examples have been discussed and/or presented in the context of flow diagrams, or flow charts, in which the methods are shown and described as a series of blocks, or steps. Unless specifically set forth in the accompanying description, it is within the scope of the present disclosure that the order of the blocks may vary from the illustrated order in the flow diagram, including with two or more of the blocks (or steps) occurring in a different order and/or concurrently. It is also within the scope of the present disclosure that the blocks, or steps, may be implemented as logic, which also may be described as implementing the blocks, or steps, as logics. In some applications, the blocks, or steps, may represent expressions and/or actions to be performed by functionally equivalent circuits or other logic devices. The illustrated blocks may, but are not required to, represent executable instructions that cause a computer, processor, and/or other logic device to respond, to perform an action, to change states, to generate an output or display, and/or to make decisions.

As used herein, the term "and/or" placed between a first entity and a second entity means one of (1) the first entity, (2) the second entity, and (3) the first entity and the second entity. Multiple entities listed with "and/or" should be construed in the same manner, i.e., "one or more" of the entities so conjoined. Other entities may optionally be present other than the entities specifically identified by the "and/or" clause, whether related or unrelated to those entities specifically identified. Thus, as a non-limiting example, a reference to "A and/or B," when used in conjunction with open-ended language such as "comprising" may refer, in one embodiment, to A only (optionally including entities other than B); in another embodiment, to B only (optionally including entities other than A); in yet another embodiment, to both A and B (optionally including other entities). These entities may refer to elements, actions, structures, steps, operations, values, and the like.

As used herein, the phrase "at least one," in reference to a list of one or more entities should be understood to mean at least one entity selected from any one or more of the entity in the list of entities, but not necessarily including at least one of each and every entity specifically listed within the list of entities and not excluding any combinations of entities in the list of entities. This definition also allows that entities may optionally be present other than the entities specifically identified within the list of entities to which the phrase "at least one" refers, whether related or unrelated to those entities specifically identified. Thus, as a non-limiting example, "at least one of A and B" (or, equivalently, "at least one of A or B," or, equivalently "at least one of A and/or B") may refer, in one embodiment, to at least one, optionally including more than one, A, with no B present (and optionally including entities other than B); in another embodiment, to at least one, optionally including more than one, B, with no A present (and optionally including entities other than A); in yet another embodiment, to at least one, optionally including more than one, A, and at least one, optionally including more than one, B (and optionally including other entities). In other words, the phrases "at least one," "one or more," and "and/or" are open-ended expressions that are both conjunctive and disjunctive in operation. For example, each of the expressions "at least one of A, B and C," "at least one of A, B, or C," "one or more of A, B, and C," "one or more of A, B, or C" and "A, B, and/or C" may mean A alone, B alone, C alone, A and B together, A and C together, B and C together, A, B and C together, and optionally any of the above in combination with at least one other entity.

In the event that any patents, patent applications, or other references are incorporated by reference herein and (1)

define a term in a manner that is inconsistent with and/or (2) are otherwise inconsistent with, either the non-incorporated portion of the present disclosure or any of the other incorporated references, the non-incorporated portion of the present disclosure shall control, and the term or incorporated disclosure therein shall only control with respect to the reference in which the term is defined and/or the incorporated disclosure was present originally.

As used herein the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically selected, created, implemented, utilized, programmed, and/or designed for the purpose of performing the function. It is also within the scope of the present disclosure that elements, components, and/or other recited subject matter that is recited as being adapted to perform a particular function may additionally or alternatively be described as being configured to perform that function, and vice versa.

As used herein, the phrase, "for example," the phrase, "as an example," and/or simply the term "example," when used with reference to one or more components, features, details, structures, embodiments, and/or methods according to the present disclosure, are intended to convey that the described component, feature, detail, structure, embodiment, and/or method is an illustrative, non-exclusive example of components, features, details, structures, embodiments, and/or methods according to the present disclosure. Thus, the described component, feature, detail, structure, embodiment, and/or method is not intended to be limiting, required, or exclusive/exhaustive; and other components, features, details, structures, embodiments, and/or methods, including structurally and/or functionally similar and/or equivalent components, features, details, structures, embodiments, and/or methods, are also within the scope of the present disclosure.

INDUSTRIAL APPLICABILITY

The drilling assemblies, systems, and methods disclosed herein are applicable to the oil and gas industry.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower, or equal in scope to the original claims, are also regarded as included within the subject matter of the inventions of the present disclosure.

The invention claimed is:

1. A method of drilling a wellbore, with a drill string of a drilling rig, within a subsurface region, the method comprising:

engaging a drilling control system in communication with the drilling rig, the drilling control system including a controller comprising a memory and a processor, the controller configured for;

(i) receiving a plurality of drilling performance indicator maps, wherein each of the plurality of drilling performance indicator maps includes information regarding a corresponding mathematically derived drilling performance indicator of a drilling operation of the drilling rig, and further wherein each of the plurality of drilling performance indicator maps describes the corresponding mathematically derived drilling performance indicator as a function of a plurality of independent drilling operational parameters of the drilling rig;

(ii) normalizing the plurality of drilling performance indicator maps with corresponding non-constant normalizing functions to generate a plurality of normalized maps, wherein the plurality of normalized maps is defined within a coextensive normalized map range;

(iii) adaptively trending the plurality of normalized maps with corresponding trending parameters to generate a plurality of trended maps, wherein the adaptively trending of a given normalized map of the plurality of normalized maps is based, at least in part, upon at least one statistical parameter derived from the corresponding mathematically derived drilling performance indicator;

(iv) summing the plurality of trended maps to generate an objective map that describes a correlation between a combination of the plurality of trended maps and the plurality of independent drilling operational parameters;

(v) selecting, from the objective map, a desired operating regime for the drilling operation; and (vi) adjusting, based at least in part on the selecting, at least one drilling operational parameter of the plurality of independent drilling operational parameters to generate a plurality of adjusted independent drilling operational parameters;

using the generated plurality of adjusted independent drilling operational parameters in the drilling control system to select an adjusted independent drilling operational parameter for operating the drill string with the drilling rig;

sending a signal from the drilling control system indicative of the selected adjusted independent drilling operational parameter to an operating controller for the drilling rig; and drilling with the drill string at least a portion of the wellbore within the subsurface region using the operating controller for the drilling rig with the selected adjusted independent drilling operational parameter.

2. The method of claim 1, wherein the normalizing includes nonlinearly normalizing at least one of the plurality of drilling performance indicator maps.

3. The method of claim 1, wherein the plurality of drilling performance indicator maps includes a rate of penetration map, and further the normalizing includes linearly normalizing the rate of penetration map between 0 and 1 according to the equation $$\overline{ROP} = \frac{ROP - ROP\min}{ROP\max - ROP\min},$$

where $\overline{ROP}$ is a normalized rate of penetration map, ROP is an individual rate of penetration data point from the rate of penetration map, $ROP_{min}$ is a minimum value of the rate of penetration map, and $ROP_{max}$ is a maximum value of the rate of penetration map.

4. The method of claim 1, wherein the plurality of drilling performance indicator maps includes a depth of cut map, and further wherein the normalizing includes linearly normalizing the depth of cut map between 0 and 1 according to the equation $$\overline{DOC} = \frac{DOC - DOC\min}{DOC\max - DOC\min},$$

where $\overline{DOC}$ is a normalized depth of cut map, DOC is an individual depth of cut data point from the depth of cut map, $DOC_{min}$ is a minimum value of the depth of cut map, and $DOC_{max}$ is a maximum value of the depth of cut map.

5. The method of claim 1, wherein the plurality of drilling performance indicator maps includes a ratio of depth of cut to weight on bit map, and further wherein the normalizing includes linearly normalizing the ratio of depth of cut to weight on bit map between 0 and 1 according to the equation $$\overline{\frac{DOC}{WOB}} = \frac{\frac{DOC}{WOB} - DOC\min}{\frac{DOC}{WOB}\max - \frac{DOC}{WOB}\min},$$

where $$\overline{\frac{DOC}{WOB}}$$

is a normalized ratio of depth of cut to weight on bit map, $$\frac{DOC}{WOB}$$

is an individual ratio of depth of cut to weight on bit data point from the ratio of depth of cut to weight on bit map, $$\frac{DOC}{WOB}\min$$

is a minimum value of the ratio of depth of cut to weight on bit map, and $$\frac{DOC}{WOB}\max$$

is a maximum value of the ratio of depth of cut to weight on bit map.

6. The method of claim 1, wherein the plurality of drilling performance indicator maps includes a mechanical specific energy map, and further wherein the normalizing includes linearly normalizing the mechanical specific energy map between 0 and 1 utilizing the equation $$\overline{MSE} = \frac{MSE\max - MSE}{MSE\max - MSE\min},$$

where $\overline{MSE}$ is a normalized mechanical specific energy map, MSE is an individual mechanical specific energy data point from the mechanical specific energy map, $MSE_{min}$ is a minimum value of the mechanical specific energy map, and $MSE_{max}$ is a maximum value of the mechanical specific energy map.

7. The method of claim 1, wherein the plurality of drilling performance indicator maps includes a torsional severity estimate map, and further wherein the normalizing includes at least one of nonlinearly normalizing the torsional severity estimate map between 0 and 1 and utilizing at least one sigmoid to normalize the torsional severity estimate map between 0 and 1.

8. The method of claim 1, wherein the normalizing includes normalizing a first map of the plurality of drilling performance indicator maps with a first non-constant normalizing function and normalizing a second map of the plurality of drilling performance indicator maps with a second non-constant normalizing function that is different from the first non-constant normalizing function.

9. The method of claim 1, wherein the normalizing includes normalizing each of the plurality of drilling performance indicator maps.

10. The method of claim 1, wherein the normalizing includes normalizing such that each of the plurality of drilling performance indicator maps is a non-dimensional drilling performance indicator map.

11. The method of claim 1, wherein the normalizing includes normalizing to emphasize one or more specific ranges of at least one of the plurality of drilling performance indicator maps.

12. The method of claim 11, wherein the normalizing further includes normalizing to deemphasize one or more other ranges of the at least one of the plurality of drilling performance indicator maps.

13. The method of claim 1, wherein the plurality of adjusted independent drilling operational parameters is a first plurality of adjusted independent drilling operational parameters, and further wherein the method includes repeating at least the selecting and the adjusting to generate a second plurality of adjusted independent drilling operational parameters that is different from the first plurality of adjusted independent drilling operational parameters.

14. The method of claim 1, wherein the plurality of drilling performance indicator maps includes a plurality of previously generated drilling performance indicator maps, and further wherein the receiving includes receiving the plurality of previously generated drilling performance indicator maps.

15. The method of claim 1, wherein the method further includes drilling the wellbore, and further wherein the receiving includes receiving at least a portion of the plurality of drilling performance indicator maps at least substantially concurrently with the drilling.

16. The method of claim 1, wherein the receiving includes mathematically calculating at least a portion of the plurality of drilling performance indicator maps based, at least in part, on raw drilling data.

17. The method of claim 1, wherein the adaptively trending includes multiplying at least one of the plurality of normalized maps by the corresponding trending parameter.

18. The method of claim 1, wherein the method further includes calculating the corresponding trending parameter based, at least in part, on a statistical analysis of a corresponding drilling performance indicator map of the plurality of drilling performance indicator maps.

19. The method of claim 1, wherein the corresponding trending parameter at least one of:

(i) includes an absolute variance of a corresponding one of each of the plurality of normalized maps;

(ii) is calculated from the equation $$\omega_i = \frac{\sigma_i}{\tilde{x}_i},$$

where $\omega_i$ is the corresponding trending parameter, $\sigma_i$ is the standard deviation of a corresponding drilling performance indicator map of each normalized map, and $\tilde{x}_i$ is a median of the corresponding drilling performance indicator map; and (iii) is calculated from the equation $$\omega_i = \frac{x_{max} - x_{min}}{\tilde{x}_i},$$

where $\omega_i$ is the corresponding trending parameter, $x_{max}$ is a maximum value of a corresponding drilling performance indicator map of each normalized map, $x_{min}$ is a minimum value of a corresponding drilling performance indicator map of each normalized map, and $\tilde{x}_i$ is a median of the corresponding drilling performance indicator map.

20. The method of claim 1, wherein the summing includes utilizing superposition.

21. The method of claim 1, wherein the desired operating regime is at least one of a local extremum, a local minimum, a local maximum, a global extremum, a global minimum, and a global maximum of the objective map.

22. The method of claim 1, wherein the selecting includes determining the plurality of adjusted independent drilling operational parameters, wherein the plurality of adjusted independent drilling operational parameters is specified by the desired operating regime.

23. The method of claim 1, wherein the selecting includes determining a desired operating range for the plurality of adjusted independent drilling operational parameters.

24. The method of claim 1, wherein the adjusting includes changing at least one drilling operational parameter of the plurality of independent drilling operational parameters from a previous value to an adjusted value.

25. The method of claim 1, wherein the method further includes inverting at least an inverted portion of the plurality of drilling performance indicator maps to generate at least one inverted map that forms a portion of the plurality of normalized maps.

26. The method of claim 1, wherein at least one of the plurality of drilling performance indicator maps is at least one of:

(i) a tabulated relationship between the corresponding mathematically derived drilling performance indicator and the plurality of independent drilling operational parameters;

(ii) an empirical relationship between the corresponding mathematically derived drilling performance indicator and the plurality of independent drilling operational parameters; and (iii) a functional relationship between the corresponding mathematically derived drilling performance indicator and the plurality of independent drilling operational parameters.

27. The method of claim 1, wherein each of the plurality of drilling performance indicator maps is defined at the same values of each drilling operational parameter of the plurality of independent drilling operational parameters as every other drilling performance indicator map of the plurality of drilling performance indicator maps.

28. The method of claim 1, wherein the method further includes operating the drilling rig, according to the plurality of adjusted independent drilling operational parameters, to drill at least a portion of the wellbore.

29. The method of claim 1, wherein the method further includes displaying at least one of:

(i) the objective map;

(ii) at least one drilling performance indicator map of the plurality of drilling performance indicator maps;

(iii) at least one normalized map of the plurality of normalized maps;

(iv) at least one trended map of the plurality of trended maps; and (v) at least one adjusted independent drilling operational parameter of the plurality of adjusted independent drilling operational parameters.

30. A drilling rig, comprising:

a drill string including a drill bit; and a drilling control system controller programmed to:

(i) perform the method of claim 1; and (ii) control the operation of the drill string on the drilling rig according to the plurality of adjusted independent drilling operational parameters.

31. Computer readable storage media including computer-executable instructions that, when executed, direct a drilling rig to perform the method of claim 1.

* * * * *